US010852653B2

(12) United States Patent
Matsuo et al.

(10) Patent No.: US 10,852,653 B2
(45) Date of Patent: Dec. 1, 2020

(54) MAGNETIC CARRIER, TWO-COMPONENT DEVELOPER, DEVELOPER FOR REPLENISHMENT, AND IMAGE FORMING METHOD

(71) Applicant: CANON KABUSHIKI KAISHA, Tokyo (JP)

(72) Inventors: Ryuichiro Matsuo, Moriya (JP); Nobuyoshi Sugahara, Tokyo (JP); Hironori Minagawa, Moriya (JP); Wakashi Iida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/548,382

(22) Filed: Aug. 22, 2019

(65) Prior Publication Data

US 2020/0073270 A1 Mar. 5, 2020

(30) Foreign Application Priority Data

Aug. 31, 2018 (JP) ..... 2018-163656

(51) Int. Cl.
*G03G 9/00* (2006.01)
*G03G 9/107* (2006.01)
*G03G 15/09* (2006.01)
*G03G 9/113* (2006.01)

(52) U.S. Cl.
CPC ..... *G03G 9/1075* (2013.01); *G03G 9/1133* (2013.01); *G03G 15/09* (2013.01)

(58) Field of Classification Search
CPC ..... G03G 9/1075; G03G 9/1133
USPC ..... 430/111.35
See application file for complete search history.

(56) References Cited

U.S. PATENT DOCUMENTS

2017/0227866 A1* 8/2017 Sugahara ..... G03G 9/08755
2019/0235407 A1* 8/2019 Nakamura ..... G03G 9/08711

FOREIGN PATENT DOCUMENTS

JP 2000-314990 A 11/2000
JP 2011-158831 A 8/2011

* cited by examiner

*Primary Examiner* — Mark A Chapman
(74) *Attorney, Agent, or Firm* — Canon U.S.A., Inc. IP Division

(57) ABSTRACT

A magnetic carrier includes a magnetic carrier particle including a magnetic carrier core particle having an amino group on a surface thereof and a resin covering layer disposed on the surface of the magnetic carrier core particle, in which the resin covering layer contains a vinyl-based copolymer and a trialkoxyalkylsilane.

11 Claims, 5 Drawing Sheets

MAGNETIC CARRIER, TWO-COMPONENT DEVELOPER, DEVELOPER FOR REPLENISHMENT, AND IMAGE FORMING METHOD

BACKGROUND OF THE INVENTION

Field of the Invention

The present disclosure relates to a magnetic carrier used in an image forming method for rendering an electrostatic latent image visible by electrophotography, a two-component developer, a developer for replenishment, and an image forming method using it.

Description of the Related Art

An electrophotographic image forming method typically employed in the related art includes forming an electrostatic latent image on an electrostatic latent image-bearing member through use of various techniques and allowing toner to adhere to the electrostatic latent image to develop the electrostatic latent image. As a development method, a two-component development system is widely used in which carrier particles called a magnetic carrier are mixed with toner, the resulting mixture is subjected to triboelectric charging to provide an appropriate amount of a positive or negative charge to the toner, and development is performed using the charge as a driving force.

The magnetic carrier can take a role in improving, for example, the stirring, conveyance, and charging, of the developer. The share of functions between the magnetic carrier and the toner can be clarified. Thus, the two-component development system has an advantage that, for example, the performance of the developer is easily controlled.

In recent years, with technological advances in the field of electrophotography, apparatuses have been increasingly stringently required to have higher definition and more stable image quality in addition to a higher speed and a longer lifetime. To deal with the demands, magnetic carriers are required to have higher performance.

To enhance the environmental stability, Japanese Patent Laid-Open No. 2000-314990 discloses that intermediate layers are each disposed between a magnetic core particle and a cover layer that covers the magnetic core particle. A carrier includes the intermediate layers each disposed on the magnetic core particle, the intermediate layers being formed using an aminosilane coupling agent having the function of controlling triboelectric charging; and the releasable cover layers containing a material that can react with and bind to the intermediate layers.

Japanese Patent Laid-Open No. 2011-158831 discloses a technique for stabilizing the amount of electrical charge even when, in particular, a carrier is left for a long time under high-temperature and high-humidity conditions. The carrier includes magnetic core particles each having a surface formed of a cover layer containing an aminosilane coupling agent; and a cover resin on the surface of the carrier, the cover resin containing an aminosilane coupling agent having a structure different from the aminosilane coupling agent present on the surface of each magnetic core particle.

However, nowadays, high-speed copying and stable image quality are required regardless of image density even in long-term use; thus, further improvements are required for high image quality and adaptability to environmental changes.

SUMMARY OF THE INVENTION

The inventors have found that even when products with low image density such as character printing are output in various environments from high-temperature and high-humidity environments to low-temperature and low-humidity environments, high-quality images are stably provided from the beginning to after the formation of a large number of images through the use of a magnetic carrier including magnetic carrier particles having a resin covering layer described below.

Aspects of the present disclosure provide a magnetic carrier includes a magnetic carrier particle including a magnetic carrier core particle having an amino group on a surface thereof and a resin covering layer disposed on the surface of the magnetic carrier core particle, in which the resin covering layer contains a vinyl-based copolymer and a compound represented by Formula (1):

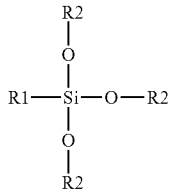

(1)

where R1 is a chain alkyl group having 6 to 12 carbon atoms, and each R2 is independently a methyl group or an ethyl group.

Further aspects of the present disclosure provide a two-component developer including the magnetic carrier and a developer for replenishment including the magnetic carrier.

Still further aspects of the present disclosure provide an image forming method using the two-component developer and/or the developer for replenishment.

Further features of the present disclosure will become apparent from the following description of exemplary embodiments with reference to the attached drawings.

DESCRIPTION OF THE EMBODIMENTS

Figure 1:
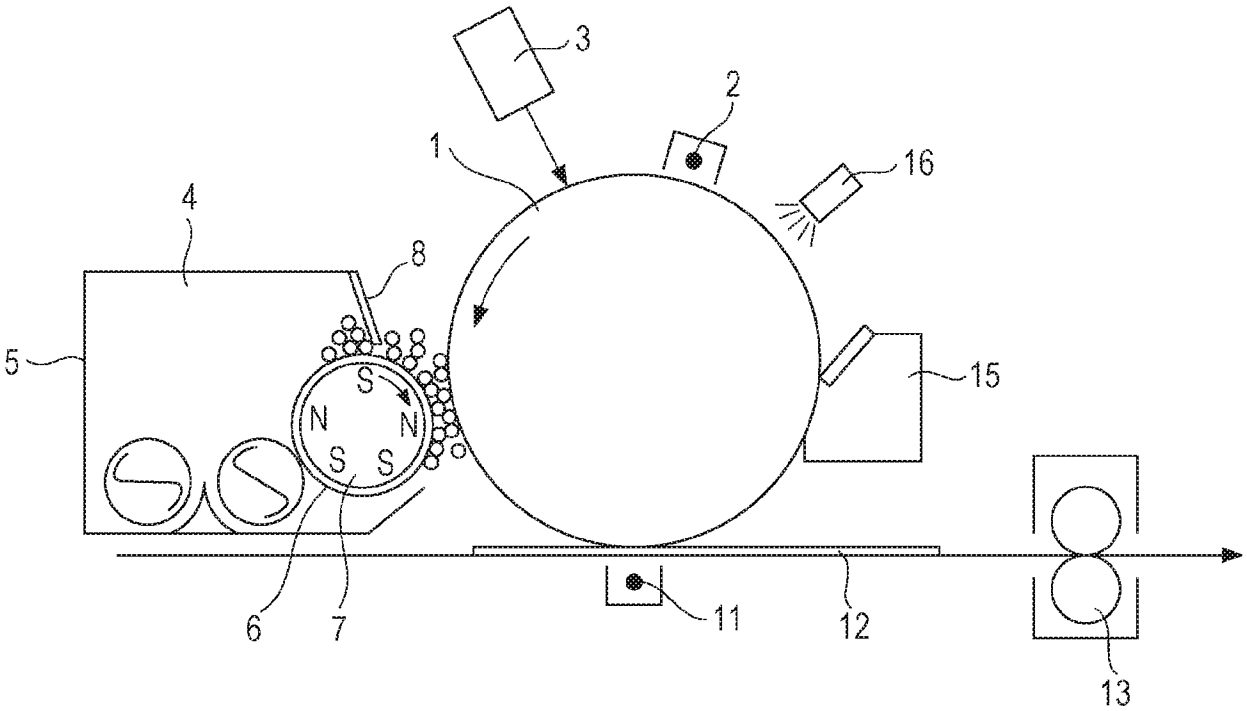
FIG. 1 is a schematic diagram of an image forming apparatus.

Typically, a developer, particularly toner, is excessively charged during long-term use at low print density; thus, an output image after long-term use has a lower image density than an output image at the beginning of use. In particular, this phenomenon occurs markedly under low-temperature and low-humidity conditions. To improve this, a method is known in which the addition of, for example, conductive particles improves charge relaxation characteristics to inhibit the decrease in the image density of the output image after long-term use. However, excessively high charge relaxation characteristics may result in charge leakage particularly in a high-temperature and high-humidity environment to increase a change in image density between the beginning of use and after long-term use. It is thus difficult to stably obtain a high-quality image equivalent to that at the beginning of use in any of low-temperature and low-humidity environments and high-temperature and high-humidity environments.

The inventors have conducted intensive studies in order to stably obtain a high-quality image equivalent to that at the beginning of use in any of low-temperature and low-humidity environments and high-temperature and high-humidity environments and have found that it is important to use a magnetic carrier including magnetic carrier particles each having a magnetic carrier core particle with an amino group on a surface thereof and a resin covering layer disposed on the surface of the magnetic carrier core particle, in which the resin covering layer contains a vinyl-based copolymer and a compound represented by Formula (1):

(1)

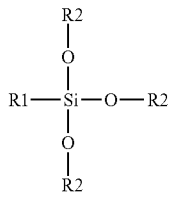

where R1 is a chain alkyl group having 6 to 12 carbon atoms, and each R2 is independently a methyl group or an ethyl group.

Resin Covering Layer

The presence of the amino group on the surface of each magnetic carrier core particle allows the alkyl group (R1) of the compound represented by Formula (1) to be oriented in the resin covering layer so as to be directed to the surface direction of the magnetic carrier particle, thereby appropriately regulating the charge relaxation characteristics of the magnetic carrier itself. For this reason, it is considered possible to stably obtain a high-quality image equivalent to that at the beginning of use in any of low-temperature and low-humidity environments and high-temperature and high-humidity environments.

From the viewpoint of controlling the charge relaxation characteristics, R1 in the compound represented by Formula (1) needs to be a chain alkyl group having 6 to 12 carbon atoms and is preferably a chain alkyl group having 6 to 10 carbon atoms. When the number of carbon atoms in the alkyl group is within the above range, the charge relaxation characteristics can be appropriate to reduce the change in image density in any of high-temperature and high-humidity environments and low-temperature and low-humidity environments.

The chain alkyl group in the compound represented by Formula (1) may be a linear alkyl group. The use of the linear alkyl group improves the orientation of the compound in the resin covering layer, enhances the charging stability, and reduces the change in image density.

A functional group (OR2) other than the alkyl group in the compound represented by Formula (1) is a methoxy group or an ethoxy group. The use of the methoxy group or ethoxy group as the functional group improves the orientation of the compound represented by Formula (1) in the resin covering layer, enhances the charging stability, and reduces the change in image density.

The compound represented by Formula (1) in the resin covering layer may be contained in an amount of 5 parts or more by mass and 30 parts or less by mass per 100 parts by mass of a resin component in the resin covering layer. When the compound is contained within the above range, the charge relaxation characteristics are appropriate, enabling the change in image density to be more satisfactorily reduced.

The cover resin contained in the resin covering layer will be described below.

The resin covering layer contains a vinyl-based copolymer.

The vinyl-based copolymer may be a copolymer (resin A) of a vinyl-based monomer having a cyclic hydrocarbon group in its molecular structure and another vinyl-based monomer. In particular, a copolymer of a (meth)acrylate having an alicyclic hydrocarbon group and a vinyl-based macromonomer may be used. The (meth)acrylate having an alicyclic hydrocarbon group is a compound having a structure represented by Formula (2):

(2)

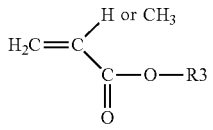

where R3 is an alicyclic hydrocarbon group.

The use of the (meth)acrylate having an alicyclic hydrocarbon group results in the resin covering layer having a smooth surface. This inhibits the adhesion of a toner-derived component to the magnetic carrier to inhibit a decrease in chargeability. The use of the vinyl-based macromonomer improves adhesion to the magnetic carrier core particle to improve the image density stability.

Examples of the (meth)acrylate having an alicyclic hydrocarbon group include cyclobutyl acrylate, cyclopentyl acrylate, cyclohexyl acrylate, cycloheptyl acrylate, dicyclopentenyl acrylate, dicyclopentanyl acrylate, cyclobutyl methacrylate, cyclopentyl methacrylate, cyclohexyl methacrylate, cycloheptyl methacrylate, dicyclopentenyl methacrylate, and dicyclopentanyl methacrylate. One or two or more thereof may be selected and used.

Examples of the vinyl-based macromonomer include, but not limited to, (meth)acrylates each having a polymer moiety obtained by the polymerization of one or more monomers selected from the group consisting of methyl acrylate, methyl methacrylate, butyl acrylate, butyl methacrylate, 2-ethylhexyl acrylate, and 2-ethylhexyl methacrylate. The (meth)acrylate having a polymer moiety is a compound having a structure represented by Formula (3):

(3)

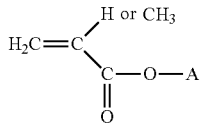

where A is a monovalent group obtained by removing one hydrogen atom from a polymer of at least one monomer selected from the group consisting of methyl acrylate, methyl methacrylate, butyl acrylate, butyl methacrylate, 2-ethylhexyl acrylate, and 2-ethylhexyl methacrylate.

The polymer moiety in the vinyl-based macromonomer (or in a unit derived therefrom) may have a peak molecular weight of 1,000 or more and 9,500 or less. When the macromonomer moiety has a peak molecular weight of 1,000 or more, a resin B described below effectively enters the macromonomer moiety to improve the toughness and the wear resistance of the resin covering layer, thereby further reducing the change in image density. When the macromonomer moiety has a peak molecular weight of 9,500 or less, the resin covering layer has sufficient charge relaxation characteristics, thus reducing the change in image density during long-term use.

The ratio (by mass) of the (meth)acrylate having an alicyclic hydrocarbon group (Ma) to the vinyl-based macromonomer (Mb) may be Ma:Mb=1:1 to 9:1. When the ratio of Ma:Mb is within the above range, good toughness and good wear resistance of the resin covering layer are provided to inhibit the peeling and scraping of the resin covering layer during long-term use and to reduce the change in image density. Additionally, the resin covering layer also has sufficient charge relaxation characteristics and thus reduces the change in image density during long-term use.

The resin A preferably has a weight-average molecular weight (Mw) of 20,000 or more and 75,000 or less, more preferably 25,000 or more and 70,000 or less in view of the coating stability.

As a monomer other than the (meth)acrylate having an alicyclic hydrocarbon group or the macromonomer, another (meth)acrylic monomer may be used as a monomer and copolymerized. Examples of another (meth)acrylic monomer include methyl acrylate, methyl methacrylate, ethyl acrylate, butyl acrylate ("butyl" refers to n-butyl, sec-butyl, isobutyl, or tert-butyl; the same applies hereafter), butyl methacrylate, 2-ethylhexyl acrylate, 2-ethylhexyl methacrylate, acrylic acid, and methacrylic acid.

From the viewpoints of achieving higher toughness and good charge relaxation characteristics of the resin covering layer, the vinyl-based copolymer may contain the resin B described below in addition to the resin A.

As the resin B used in the resin covering layer, a copolymer of a styrene-based monomer and a (meth)acrylate represented by Formula (4) may be used:

(4)

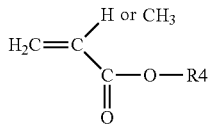

where R4 is a chain alkyl group having 2 to 8 carbon atoms.

The use of the styrene-based monomer results in a high glass transition temperature and enables the toughness of the resin covering layer to be maintained even at a low molecular weight. Because the (meth)acrylate is contained, a high affinity for a macromonomer-derived unit contained in the resin A is provided, and the resin B more effectively enters the macromonomer moiety. It is thus possible to achieve both of improvements in the toughness and the wear resistance of the resin covering layer and the suppression of decreases in density uniformity in an image plane and thin-line reproducibility.

Non-limiting examples of a compound that can be used as the styrene-based monomer are described below.

Examples thereof include styrene; and styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene.

Non-limiting examples of a resin used as the resin B include styrene-based copolymers such as styrene-ethyl acrylate copolymers, styrene-butyl acrylate copolymers, styrene-octyl acrylate copolymers, styrene-ethyl methacrylate copolymers, styrene-butyl methacrylate copolymers, and styrene-octyl methacrylate copolymers. These may be used alone or in combination.

In the resin B, the proportion of the (meth)acrylate to the styrene-based monomer is preferably 5 to 6,000 ppm, more preferably 10 to 5,000 ppm. When the proportion of the monomers is within the above range, the toughness of the resin covering layer is increased, and the affinity between a (meth)acrylate monomer portion and a macromonomer portion is increased. It is thus possible to satisfactorily achieve both of improvements in the toughness and the wear resistance of the resin covering layer and the suppression of the decreases in density uniformity in the image plane and thin-line reproducibility.

In the molecular weight distribution of the vinyl-based copolymer, a peak originating from the resin B may be in the molecular weight range of 2,000 or more and 9,000 or less from the viewpoints of prolonging the lifetime and suppressing the decreases in density uniformity in the image plane and thin-line reproducibility. When the peak originating from the resin B is in the molecular weight range of less than 1,000, the toughness and the wear resistance of the resin covering layer may decrease to cause the peeling and scraping of the resin covering layer during long-term use, and the change in image density tends to be significant. When the peak originating from the resin B is in the molecular weight range of more than 9,500, the resin B does not have sufficient charge relaxation characteristics; thus, the density uniformity in the image plane and the thin-line reproducibility tend to decrease.

Preferably, the percentage of the resin A in the vinyl-based copolymer is 10% or more by mass and 99% or less by mass, and the percentage of the resin B is 1% or more by mass and 90% or less by mass. More preferably, the percentage of the resin A is 50% or more by mass and 80% or less by mass, and the percentage of the resin B is 20% or more by mass and 50% or less by mass. When the resin A and the resin B are within the above ranges, it is possible to achieve both of improvements in the toughness and the wear resistance of the resin covering layer and the suppression of the decreases in density uniformity in the image plane and thin-line reproducibility.

The amount of the cover resin may be 1.0 part or more by mass and 3.0 parts or less by mass per 100 parts by mass of the magnetic carrier core particles. When the amount of the cover resin is 1.0 parts or more by mass, the toughness and the wear resistance of the resin is increased to suppress the change in image density. When the amount of the cover resin is 3.0 parts or less by mass, the charge relaxation characteristics are further improved to further suppress the decreases in density uniformity in the image plane and thin-line reproducibility.

Magnetic Carrier Core Particle

The magnetic carrier core particles will be described below.

As the magnetic carrier core particles used for the magnetic carrier, known magnetic carrier core particles may be used. Porous magnetic core particles each containing a resin in a pore portion thereof may be used. The use of the porous magnetic core particles enables the magnetic carrier to have a low true density and thus a load on the toner to be reduced. Thereby, during long-term use, the image quality is less deteriorated, and the replacement frequency of a developer composed of toner and the carrier can be reduced.

The porous magnetic core particles will be described below.

The material of the porous magnetic core particles may be magnetite or ferrite. The material of the porous magnetic core particles may be ferrite because the porous structure of the porous magnetic core particles can be controlled and because the resistance can be adjusted.

Ferrite is a metal oxide represented by the following general formula:

$$(M1_2O)_x(M2O)_y(Fe_2O_3)_z$$

where M1 is a monovalent metal, M2 is a divalent metal, and when $x+y+z=1.0$, $0 \leq x \leq 0.8$, $0 \leq y \leq 0.8$, and $0.2<z<1.0$.

In the general formula, M1 and M2 each may be one or more metal atoms selected from the group consisting of Li, Fe, Mn, Mg, Sr, Cu, Zn, and Ca. Examples of another element that can be used include Ni, Co, Ba, Y, V, Bi, In, Ta, Zr, B, Mo, Na, Sn, Ti, Cr, Al, Si, and rare-earth elements.

To maintain appropriate magnetization and control the pore diameter to a desired range, the magnetic carrier is required to have appropriate surface irregularities of each of the porous magnetic core particles. It is also necessary to easily control the ferritization rate and to appropriately control the specific resistance and the magnetic force of the porous magnetic core. From the above viewpoints, the porous magnetic particles may be composed of Mn element-containing ferrite such as Mn ferrite, Mn—Mg ferrite, Mn—Mg—Sr ferrite, or Li—Mn ferrite.

In the case where porous ferrite particles are used as the magnetic carrier core particles, a production process thereof will be described in detail below.

Step 1 (Weighing and Mixing Step)

Raw materials of ferrite are weighed and mixed together.

Examples of the raw materials of ferrite include metallic particles, oxides, hydroxides, oxalates, and carbonates of the foregoing metal elements.

Examples of a mixing apparatus include ball mills, planetary mills, Giotto mills, and vibration mills. In particular, ball mills may be used in view of mixing properties.

Specifically, weighed raw materials for ferrite and balls are placed into a ball mill. The materials are pulverized and mixed for 0.1 to 20.0 hours.

Step 2 (Calcination Step)

The resulting raw material mixture for ferrite is calcined at a calcination temperature of 700° C. to 1,200° C. for 0.5 to 5.0 hours in air or a nitrogen atmosphere to produce ferrite. Examples of a furnace used in the calcination include burner furnaces, rotary furnaces, and electric furnaces.

Step 3 (Pulverization Step)

The calcined ferrite produced in the step 2 is pulverized with a pulverizer.

Any pulverizer that can achieve a desired particle diameter may be used. Examples thereof include crushers, hammer mills, ball mills, bead mills, planetary mills, and Giotto mills.

To achieve a desired particle diameter of the pulverized ferrite, in the case of using, for example, a ball mill or a bead mill, the material and size of balls or beads used and the operating time may be controlled. Specifically, in order to reduce the particle diameter of the calcined ferrite slurry, balls having a high specific gravity and a long pulverization time may be used. To provide a broad particle size distribution of the calcined ferrite, balls or beads having a high specific gravity and a short pulverization time may be used. Also, by mixing calcined ferrites having different particle diameters, calcined ferrite having a broad particle size distribution may be provided.

In the case of the ball mill or bead mill, a wet process has higher pulverization efficiency than a dry process because the pulverized product is not stirred up. Thus, the wet process may be used rather than the dry process.

Step 4 (Granulation Step)

Water, a binder, and, if necessary, a pore modifier are added to the pulverized calcined ferrite. Examples of the pore modifier include foaming agents and fine resin particles. Examples of foaming agents include sodium bicarbonate, potassium bicarbonate, lithium bicarbonate, ammonium bicarbonate, sodium carbonate, potassium carbonate, lithium carbonate, and ammonium carbonate. Examples of fine resin particles include fine particles composed of polyester, polystyrene, styrene copolymers such as styrene-vinyltoluene copolymers, styrene-vinylnaphthalene copolymers, styrene-acrylate copolymers, styrene-methacrylate copolymers, styrene-methyl α-chloromethacrylate copolymer, styrene-acrylonitrile copolymers, styrene-vinyl methyl ketone copolymers, styrene-butadiene copolymers, styrene-isoprene copolymers, and styrene-acrylonitrile-indene copolymers, poly(vinyl chloride), phenolic resins, modified phenolic resins, maleic resins, acrylic resins, methacrylic resins, poly(vinyl acetate), silicone resins, polyester resins each containing a monomer, serving as a structural unit, selected from aliphatic polyhydric alcohols, aliphatic dicarboxylic acids, aromatic dicarboxylic acids, aromatic dialcohols, and diphenols, polyurethane resins, polyamide resins, poly(vinyl butyral), terpene resins, coumarone-indene resins, petroleum resins, and hybrid resins each having a polyester unit and a vinyl-based polymer unit.

As the binder, for example, poly(vinyl alcohol) is used.

In the case where the pulverization is performed by the wet process in the step 3, the binder and, if necessary, the pore modifier may be added in consideration of water contained in the ferrite slurry.

The resulting ferrite slurry is dried and granulated with a spray dryer in an atmosphere at 100° C. to 200° C. Any spray dryer that can achieve a desired particle diameter of the porous magnetic core particles may be used.

Step 5 (Firing Step)

The granulated product is fired at 800° C. to 1,400° C. for 1 to 24 hours.

When the firing is performed at a higher firing temperature for a longer firing time, the sintering of the porous magnetic core particles proceeds to reduce the pore diameter and the number of the pores.

Step 6 (Screening Step)

After the particles fired as described above are disaggregated, coarse particles and fine particles may be removed by classification or sifting with a sieve.

The magnetic carrier particles may have a 50% particle diameter (D50) of 18.0 to 68.0 μm based on the volume distribution in order to suppress the adhesion of the carrier to images and the formation of low-resolution images.

Step 7 (Filling Step)

The porous magnetic core particles may have low physical strength, depending on the internal pore volume. To provide the physical strength sufficient for a magnetic carrier, at least some of the pores of the porous magnetic core particles may be filled with a resin. The amount of the resin filled into the porous magnetic core particles may be 2% to 15% by mass with respect to the porous magnetic core particles. In the case of small variations in the resin content of each magnetic carrier, only some of the internal voids may be filled with the resin, only voids in the vicinity of the surface of each porous magnetic core particle may be filled with the resin while voids are left inside, or the internal voids may be completely filled with the resin.

Non-limiting examples of a method for filling the pores in the porous magnetic core particles with the resin include dipping methods, spray methods, brushing methods, and fluidized beds. Such an application method includes immersing the porous magnetic core particles in a resin solution and then evaporating a solvent. As a method for filling the voids between the porous magnetic core particles with the resin, a method can be employed in which the resin is diluted in a solvent and the resulting resin solution is added to the voids in the porous magnetic core particles. The solvent used here may be any solvent that can dissolve the resin. In the case where the resin is soluble in an organic solvent, examples of the organic solvent include toluene, xylene, cellosolve butyl acetate, methyl ethyl ketone, methyl isobutyl ketone, and methanol. In the case where the resin is a water-soluble resin or an emulsion resin, water may be used as a solvent.

The resin solution preferably has a resin solid content of 1% to 50% by mass, more preferably 1% to 30% by mass. When the resin solid content is within the above range, the resin solution penetrates easily and uniformly into the voids between the porous magnetic core particles, and the adhesion of the resin to the porous magnetic core particles is appropriate.

As a resin filled into the voids between the porous magnetic core particles, either a thermoplastic resin or a thermosetting resin may be used. A resin having an affinity for the porous magnetic core particles may be used. In the case of using the high-affinity resin, when the voids between the porous magnetic core particles are filled with the resin, the surfaces of the porous magnetic core particles can be also covered with the resin.

Examples of the thermoplastic resin that can be used as a resin to be filled include novolac resins, saturated alkyl polyester resins, polyarylate, polyamide resins, and acrylic resins. Examples of the thermosetting resin include phenolic resins, epoxy resins, unsaturated polyester resins, and silicone resins.

Amino groups are present on the surfaces of the magnetic carrier core particles. The presence of the amino groups on the surfaces of the magnetic carrier core particles results in an interaction with the compound represented by Formula (1) contained in the resin covering layer, thereby providing the advantageous effects of the present disclosure.

The amount of amino groups present on the surfaces of the magnetic carrier core particles can be determined by performing elemental analysis of the surfaces of the magnetic carrier core particles using X-ray photoelectron spectroscopy (XPS) and determining the N element content based thereon. The N element content is preferably 0.50% or more by mass and 7.00% or less by mass, more preferably 1.00% or more by mass and 5.00% or less by mass. When the N element content on the surfaces of the magnetic carrier core particles is 0.50% or more by mass, a good orientation state of the compound represented by Formula (1) is provided; thus, the change in image density in a high-temperature and high-humidity environment tends to be reduced. When the N element content on the surfaces of the magnetic carrier core particles is 7.00% or less by mass, excessive charging in a low-temperature and low-humidity environment is inhibited; thus, the change in image density in a low-temperature and low-humidity environment tends to be reduced.

As a method for allowing amino groups to be present on the surfaces of the magnetic carrier core particles, a method may be employed in which the surfaces of untreated particles are treated with an amino group-containing silane coupling agent. Specifically, the amino group-containing silane coupling agent diluted to about 10 times with an organic solvent such as toluene under heating at 60° C. to 80° C. may be applied to the surfaces of the magnetic carrier core particles and then heated at 140° C. to 160° C. for 1 to 3 hours in a nitrogen atmosphere. Examples of the amino group-containing silane coupling agent include γ-aminopropyltrimethoxysilane and γ-aminopropyltriethoxysilane.

Magnetic Carrier

The magnetic carrier according to an embodiment of the present disclosure includes the resin covering layer disposed on the surface of each of the magnetic carrier core particles.

Non-limiting examples of a method for covering the surfaces of the magnetic carrier core particles with a resin include application methods such as dipping methods, spray methods, brushing methods, dry methods, and fluidized beds.

The resin covering layer may contain conductive particles, charge-controllable particles, and a charge-controllable material. Examples of the material of the conductive particles include carbon black, magnetite, graphite, zinc oxide, and tin oxide.

The amount of the conductive particles added may be 0.1 parts or more by mass and 10.0 parts or less by mass per 100 parts by mass of the cover resin in order to adjust the resistance of the magnetic carrier.

Examples of the charge-controllable particles include particles of organometallic complexes, particles of organometallic salts, particles of chelate compounds, particles of monoazo metal complexes, particles of acetylacetone metal complexes, particles of hydroxycarboxylic acid metal complexes, particles of polycarboxylic acid metal complexes, particles of polyol metal complexes, particles of poly(methyl methacrylate) resins, particles of polystyrene resins, particles of melamine resins, particles of phenolic resins, particles of nylon resins, silica particles, titanium oxide particles, and alumina particles. The amount of the charge-controllable particles may be 0.5 parts or more by mass and 50.0 parts or less by mass per 100 parts by mass of the cover resin in order to adjust the amount of triboelectric charge.

When a voltage of 500 V is applied to the magnetic carrier, a current of 10.0 μA or more and 100.0 μA or less may flow. At a current of 10.0 μA or more, decreases in density uniformity in an image plane and character quality are further suppressed. At a current of 100.0 μA or less, the occurrence of what is called "fogging", in which insufficiently charged toner is transferred to a non-image area, is suppressed.

The magnetic carrier may have a specific resistance of $1.0\times10^5$ Ω·cm or more and $1.0\times10^{10}$ Ω·cm or less at an electric field intensity of 2,000 V/cm. A specific resistance of $1.0\times10^5$ Ω·cm or more, the occurrence of "fogging" is suppressed. At a specific resistance of $1.0\times10^{10}$ Ω·cm or less, decreases in density uniformity in the image plane and character quality are further suppressed.

Toner

A configuration of toner will be described in detail below.

The toner includes toner particles containing a binder resin, a colorant, and a release agent.

Examples of the binder resin include vinyl resins, polyester resins, and epoxy resins. Among these, vinyl resins and polyester resins may be used in view of chargeability and fixability. In particular, polyester resins may be used. As the binder resin, resins having different types and different physical properties (for example, different molecular weights or different acid values) may be used in combination.

The binder resin preferably has a glass transition temperature of 45° C. to 80° C., more preferably 55° C. to 70° C. The binder resin may have a number-average molecular weight (Mn) of 2,500 to 50,000 and a weight-average molecular weight (Mw) of 10,000 to 1,000,000.

To promote the plasticity effect of the toner to improve the low-temperature fixability, a crystalline polyester resin may be added to the toner.

Examples of the crystalline polyester include polycondensates of monomer mixtures mainly containing aliphatic diols having 2 to 22 carbon atoms and aliphatic dicarboxylic acids having 2 to 22 carbon atoms.

Examples of the aliphatic diols having 2 to 22 carbon atoms, for example, 6 to 12 carbon atoms include chain aliphatic diols such as linear aliphatic diols. Among these, examples thereof include linear aliphatic α,Ω-diols such as ethylene glycol, diethylene glycol, 1,4-butanediol, and 1,6-hexanediol.

An alcohol selected from the aliphatic diols having 2 to 22 carbon atoms preferably accounts for 50% or more by mass, more preferably 70% or more by mass of the alcohol components.

A polyhydric alcohol other than aliphatic diols may be used. Examples of a dihydric alcohol include aromatic alcohols, such as polyoxyethylenated bisphenol A and polyoxypropylenated bisphenol A, and 1,4-cyclohexanedimethanol.

Examples of a tri- or higher-hydric alcohol include aromatic alcohols such as 1,3,5-trihydroxymethylbenzene; and aliphatic alcohols such as pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, and trimethylolpropane.

Additionally, a monohydric alcohol may be used to the extent that the properties of the crystalline polyester are not impaired.

Non-limiting examples of the aliphatic dicarboxylic acids having 2 or more and 22 or less carbon atoms, for example, 6 or more and 12 or less carbon atoms include chain aliphatic dicarboxylic acids, such as linear aliphatic dicarboxylic acids. Acid anhydrides thereof and lower-alkyl esters thereof are also included.

A carboxylic acid selected from the aliphatic dicarboxylic acids having 2 or more and 22 or less carbon atoms preferably accounts for 50% or more by mass, more preferably 70% or more by mass of the carboxylic components.

A polycarboxylic acid having 2 or more and 22 or less carbon atoms other than the aliphatic dicarboxylic acids may be used. Examples of divalent carboxylic acids among other polycarboxylic acid monomers include aromatic carboxylic acids such as isophthalic acid and terephthalic acid; aliphatic carboxylic acids such as n-dodecylsuccinic acid and n-dodecenylsuccinic acid; and alicyclic carboxylic acids such as cyclohexanedicarboxylic acid. Acid anhydrides thereof and lower-alkyl esters thereof are also included.

Examples of tri- or higher-valent carboxylic acids include aromatic carboxylic acids such as 1,2,4-benzenetricarboxylic acid (trimellitic acid), 2,5,7-naphthalenetricarboxylic acid, 1,2,4-naphthalenetricarboxylic acid, and pyromellitic acid; and aliphatic carboxylic acids such as 1,2,4-butanetricarboxylic acid, 1,2,5-hexanetricarboxylic acid, and 1,3-dicarboxy-2-methyl-2-methylenecarboxypropane. Acid anhydrides thereof and lower-alkyl esters thereof are also included.

Additionally, a monovalent carboxylic acid may be contained to the extent that the properties of the crystalline polyester are not impaired.

The crystalline polyester can be produced according to a usual method for synthesizing polyester. For example, a desired crystalline polyester can be synthesized by subjecting the carboxylic acid monomer and the alcohol monomer to an esterification reaction or a transesterification reaction and then subjecting the reaction mixture to a polycondensation reaction in the usual manner under reduced pressure or a stream of nitrogen gas.

The amount of the crystalline polyester used is preferably 0.1 to 30 parts by mass, more preferably 0.5 to 20 parts by mass, even more preferably 3 to 15 parts by mass per 100 parts by mass of the binder resin.

Examples of the colorant used in an embodiment of the present disclosure are described below.

Examples of a black colorant include carbon black; and a colorant adjusted to black using a yellow colorant, a magenta colorant, and a cyan colorant.

Examples of a color pigment for magenta toner include condensed azo compounds, diketopyrrolopyrrole compounds, anthraquinone, quinacridone compounds, basic dye lake compounds, naphthol compounds, benzimidazolone compounds, thioindigo compounds, and perylene compounds. Specific examples thereof include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 144, 146, 150, 163, 166, 169, 177, 184, 185, 202, 206, 207, 209, 220, 221, 238, 254, and 269, C.I. Pigment Violet 19, and C.I. Vat Red 1, 2, 10, 13, 15, 23, 29, and 35.

A pigment may be used alone as a colorant. However, from the viewpoint of achieving good image quality of full-color images, a combination of a dye and a pigment may be used because of its improved brightness.

Examples of a dye for magenta toner include oil dyes such as C.I. Solvent Red 1, 3, 8, 23, 24, 25, 27, 30, 49, 81, 82, 83, 84, 100, 109, and 121, C.I. Disperse Red 9, C.I. Solvent Violet 8, 13, 14, 21, and 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, and 40, and C.I. Basic Violet 1, 3, 7, 10, 14, 15, 21, 25, 26, 27, and 28.

Examples of a color pigment for cyan toner include C.I. Pigment Blue 1, 2, 3, 7, 15:2, 15:3, 15:4, 16, 17, 60, 62, and 66, C.I. Vat Blue 6, C.I. Acid Blue 45, and a copper phthalocyanine pigment having a phthalocyanine framework substituted with 1 to 5 phthalimidomethyl groups.

Examples of a color pigment for yellow toner include condensed azo compounds, isoindolinone compounds, anthraquinone compounds, azo metal compounds, methine compounds, and arylamide compounds. Specific examples thereof include C.I. Pigment Yellow 1, 2, 3, 4, 5, 6, 7, 10, 11, 12, 13, 14, 15, 16, 17, 23, 62, 65, 73, 74, 83, 93, 95, 97, 109, 110, 111, 120, 127, 128, 129, 147, 155, 168, 174, 180, 181, 185, and 191, and C.I. Vat Yellow 1, 3, and 20. Additionally, dyes such as C.I. Direct Green 6, C.I. Basic Green 4, C.I. Basic Green 6, and C.I. Solvent Yellow 162 may also be used.

The amount of the colorant used is preferably 0.1 to 30 parts by mass, more preferably 0.5 to 20 parts by mass, particularly preferably 3 to 15 parts by mass per 100 parts by mass of the binder resin.

In the toner according to an embodiment of the present disclosure, a charge control agent may be used as needed in order to further stabilize the chargeability. The charge control agent may be used in an amount of 0.5 to 10 parts by mass per 100 parts by mass of the binder resin.

Examples of the charge control agent are described below.

As a negative-charge control agent that controls the toner to be negatively chargeable, for example, organometallic complexes and chelate compounds are effective. Examples thereof include monoazo metal complexes, metal complexes of aromatic hydroxycarboxylic acids, and metal complexes of aromatic dicarboxylic acids. Other examples thereof include aromatic hydroxycarboxylic acids, aromatic mono- and polycarboxylic acids and metal salts thereof, anhydrides thereof, and esters thereof, and phenol derivatives of bisphenols.

Examples of a positive-charge control agent that controls the toner to be positively chargeable include nigrosine and modified nigrosine with, for example, metal salts of fatty acids; onium salts, such as quaternary ammonium salts, e.g., tributylbenzylammonium 1-hydroxy-4-naphthosulfonate and tetrabutylammonium tetrafluoroborate, and their phosphonium salt analogues, and chelate dyes thereof, such as triphenylmethane dyes, and lake pigments thereof (examples of a laking agent include phosphotungstic acid, phosphomolybdic acid, phosphotungstomolybdic acid, tannic acid, lauric acid, gallic acid, ferricyanic acid, and ferrocyanides); and metal salts of higher fatty acids, such as diorganotin oxides, e.g., dibutyltin oxide, dioctyltin oxide, and dicyclohexyltin oxide, and diorganotin borates, e.g., dibutyltin borate, dioctyltin borate, and dicyclohexyltin borate.

According to an embodiment of the present disclosure, the toner particles may contain the release agent. Examples of the release agent are described below.

Aliphatic hydrocarbon wax such as low-molecular-weight polyethylene, low-molecular-weight polypropylene, microcrystalline wax, or paraffin wax may be used. Other examples thereof include oxides of aliphatic hydrocarbon wax such as oxidized polyethylene wax and block copolymers thereof; wax mainly containing fatty esters such as carnauba wax, sazol wax, and montanate wax; and compounds such as deoxidized carnauba wax, prepared by partially or entirely deoxidizing fatty esters.

The amount of the release agent is preferably 0.1 to 20 parts by mass, more preferably 0.5 to 10 parts by mass per 100 parts by mass of the binder resin.

The melting point of the release agent is measured with a differential scanning calorimeter (DSC) and is defined by the maximum endothermic peak temperature during temperature increase. The melting point of the release agent is preferably 65° C. to 130° C., more preferably 80° C. to 125° C.

A fine powder in which the external addition of the fine powder to the toner particles increases the flowability of the resulting toner as compared with before the addition may be used as a flowability improver for the toner. Examples of the fine powder include fluorine-containing resin powders such as a vinylidene fluoride fine powder and a polytetrafluoroethylene fine powder; fine silica powders such as silica powders prepared by wet processes and silica powders prepared by dry processes; and fine titanium oxide powders and fine alumina powders. These powders may be subjected to hydrophobic treatment by surface treatment with, for example, a silane coupling agent, a titanium coupling agent, or silicone oil in such a manner that the degree of hydrophobicity is in the range of 30 to 80, the degree of hydrophobicity being measured by a methanol titration test.

The externally additive is preferably used in an amount of 0.1 to 10 parts by mass, more preferably 0.2 to 8 parts by mass per 100 parts by mass of the toner.

Two-Component Developer

In the case where a mixture of the toner and the magnetic carrier is used as a two-component developer, the two-component developer preferably has a toner concentration of 2% to 15% by mass, more preferably 4% to 13% by mass.

In the case of a developer for replenishment supplied to a developing unit in response to a decrease in toner concentration of the two-component developer in the developing unit, the developer for replenishment may contain 2 parts or more by mass and 50 parts or less by mass of the toner per 1 part by mass of a magnetic carrier for replenishment.

Image Forming Method and Image Forming Apparatus

An image forming apparatus including a developing device in which the magnetic carrier, the two-component developer, and the developer for replenishment according to an embodiment of the present disclosure are used will be described below by taking an example.

In a typical image forming method, an image is formed through the following steps: a charging step of charging an electrostatic latent image-bearing member, an electrostatic latent image formation step of forming an electrostatic latent image on the surface of the electrostatic latent image-bearing member, a development step of developing the electrostatic latent image with a two-component developer to form a toner image, a transfer step of transferring the toner image to a transfer material with or without an intermediate transfer member, and a fixing step of fixing the transferred toner image on the transfer material.

The following control may be performed: the developer for replenishment is supplied to the developing unit in response to a decrease in toner concentration of the two-component developer in the developing unit, and an excess of the magnetic carrier in the developing unit is discharged from the developing unit as needed.

Figure 2:
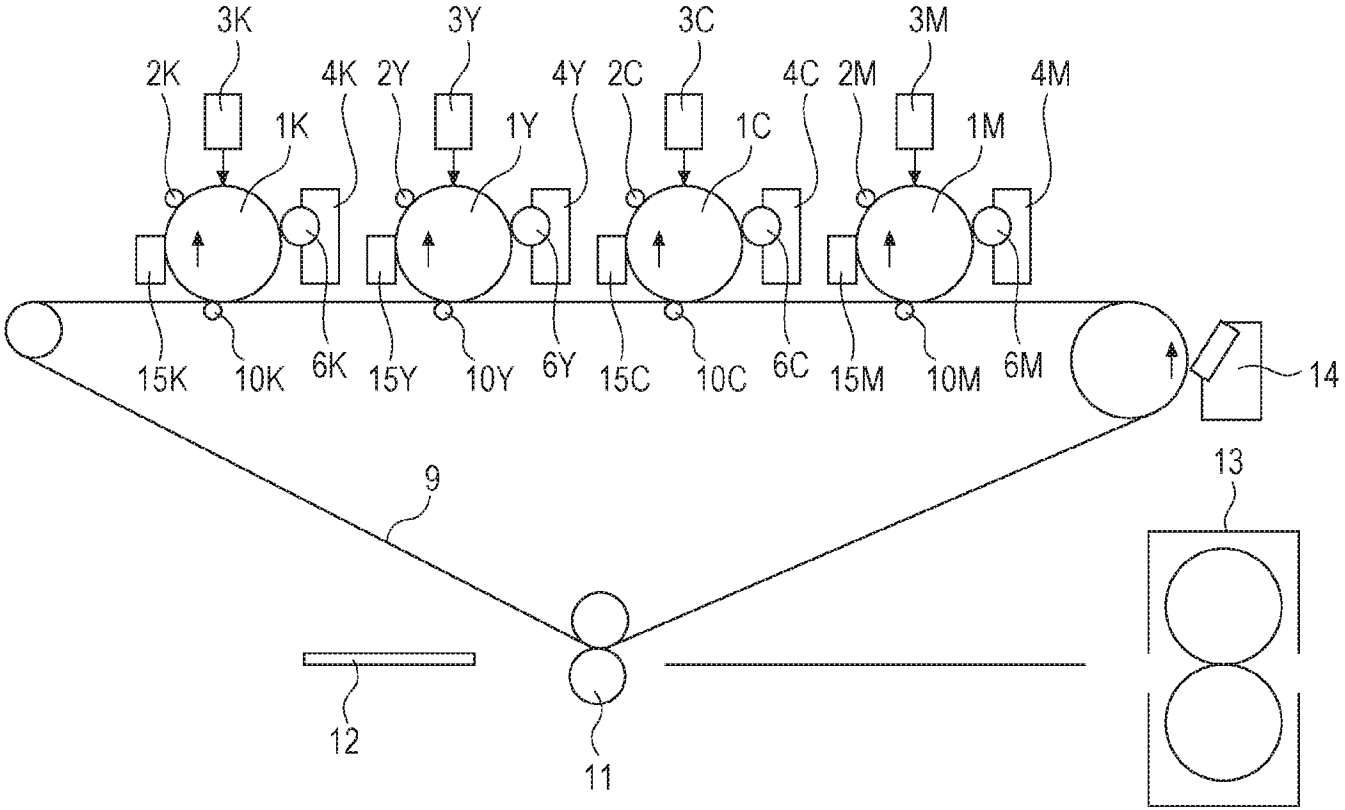
FIG. 2 is a schematic diagram of an image forming apparatus.

A more detailed description is given below with reference to the drawings. In FIG. 1, an electrostatic latent image-bearing member 1 rotates in the direction indicated by an arrow. The electrostatic latent image-bearing member 1 is charged by a charging unit 2 serving as charging means. The surface of the charged electrostatic latent image-bearing member 1 is exposed to light emitted from an exposure unit 3, serving as electrostatic latent image-forming means, to form an electrostatic latent image. A developing unit 4 includes a developer container 5 containing a two-component developer and a rotatable developer carrier 6. The developer carrier 6 includes magnets 7 serving as magnetic field-generating means in the developer carrier 6. At least one of the magnets 7 faces the electrostatic latent image-bearing member 1. The two-component developer is held on the developer carrier 6 in a magnetic field generated by the magnet 7. The amount of two-component developer is regulated by a regulating member 8. The two-component developer is conveyed to a developing section opposite the electrostatic latent image-bearing member 1. The magnetic field generated by the magnet 7 forms a magnetic brush in the developing section. The application of a developing bias formed by superimposing an alternating electric field on a dc electric field visualizes the electrostatic latent image as a toner image. The toner image on the electrostatic latent image-bearing member 1 is electrostatically transferred to a recording medium 12 with a charging unit for transfer 11. As illustrated in FIG. 2, a toner image on the electrostatic latent image-bearing member 1 may be temporarily transferred to an intermediate transfer member 9 and then electrostatically transferred to the transfer material (recording medium) 12. The recording medium 12 is conveyed to a fixing unit 13. Here, the recording medium 12 is heated and pressed to fix the toner on the recording medium 12. The recording medium 12 is then ejected as an output image from the apparatus. After this transferring step, the residual toner on the electrostatic latent image-bearing member 1 is removed with a cleaner 15. The electrostatic latent image-bearing member 1 cleaned with the cleaner 15 is electrically initialized by light irradiation with a pre-exposure lamp 16. These image forming operations are repeated.

FIG. 2 is a schematic diagram of an example of a full-color image forming apparatus.

The arrangement of image forming units K, Y, C, and M and the rotation directions indicated by arrows in the figure may be modified. K denotes black, Y denotes yellow, C denotes cyan, and M denotes magenta. In FIG. 2, electrostatic latent image-bearing members 1K, 1Y, 1C, and 1M rotate in the directions indicated by the arrows. The electrostatic latent image-bearing members are charged with charging units 2K, 2Y, 2C, and 2M serving as charging means. The surfaces of the charged electrostatic latent image-bearing members are exposed to light emitted from exposure units 3K, 3Y, 3C, and 3M serving as electrostatic latent image-forming means to form electrostatic latent images. The electrostatic latent images are then visualized as toner images with a two-component developer carried by developer carriers 6K, 6Y, 6C, and 6M disposed on developing units 4K, 4Y, 4C, and 4M serving as developing means. The toner images are transferred to the intermediate transfer member 9 with intermediate charging units for transfer 10K, 10Y, 10C, and 10M serving as transfer means. The toner images are transferred to the recording medium 12 with the charging unit for transfer 11 serving as transfer means. The recording medium 12 is fixed by heating and pressing in the fixing unit 13 serving as fixing means and is output as an image. The residual toner and so forth are recovered with an intermediate transfer member cleaner 14 serving as a cleaning member for the intermediate transfer member 9. In a developing method according to an embodiment of the present disclosure, specifically, developing may be performed while an alternating voltage is applied to a developer carrier to form an alternating electric field in a developing region and a magnetic brush is in contact with a photosensitive member. To prevent carrier adhesion and improve dot reproducibility, the distance (S-D distance) between a developer carrier (developing sleeve) 6 and a photoconductive drum may be 100 to 1,000 μm. Reference numerals 15K, 15Y, 15C, and 15M denote cleaners for the electrostatic latent image-bearing members.

The peak-to-peak voltage (Vpp) of the alternating electric field is 300 to 3,000 V, preferably 500 to 1,800 V. The frequency thereof is 500 to 10,000 Hz, preferably 1,000 to 7,000 Hz. The peak-to-peak voltage and the frequency may each be appropriately selected in accordance with the process. In this case, examples of the waveform of an alternating-current bias for forming the alternating electric field include triangular waves, rectangular waves, sine waves, and waves with different duty ratios. To accommodate variations in the formation speed of a toner image, the development may be performed while a developing bias voltage including a discontinuous alternating current bias voltage (an intermittent alternating superimposed voltage) is applied to the developer carrier.

The use of the two-component developer containing a satisfactorily charged toner can reduce the fog removal voltage (Vback) and the primary charging of the photosensitive member, thereby prolonging the lifetime of the photosensitive member. The fog removal voltage (Vback) is 200 V or less, such as 150 V or less, in accordance with the developing system. To produce a sufficient image density, a contrast potential of 100 to 400 V may be used.

As the photosensitive member of the electrostatic latent image-bearing member, a known photosensitive member may be used. An example thereof is a photosensitive member including a conductive layer, an undercoat layer, a charge generation layer, a charge transport layer, and, if necessary, a charge injection layer disposed in this order on a conductive substrate composed of, for example, aluminum or stainless steel. The conductive layer, the undercoat layer, the charge generation layer, and the charge transport layer may be those commonly used in photosensitive members. As the outermost layer, for example, the charge injection layer or a protective layer may be used.

Measurement Method

Measurement methods of physical properties specified in an embodiment of the present disclosure will be described below.

(i) Measurement of Specific Resistance of Magnetic Carrier and Magnetic Carrier Core Particle The specific resistance of the magnetic carrier and the magnetic carrier core particles is measured with a measuring apparatus schematically illustrated in FIG. 3. The specific resistance of the magnetic carrier is measured at an electric field strength of 2,000 (V/cm). The specific resistance of the porous magnetic core particles is measured at an electric field strength of 300 (V/cm).

Figure 3A:
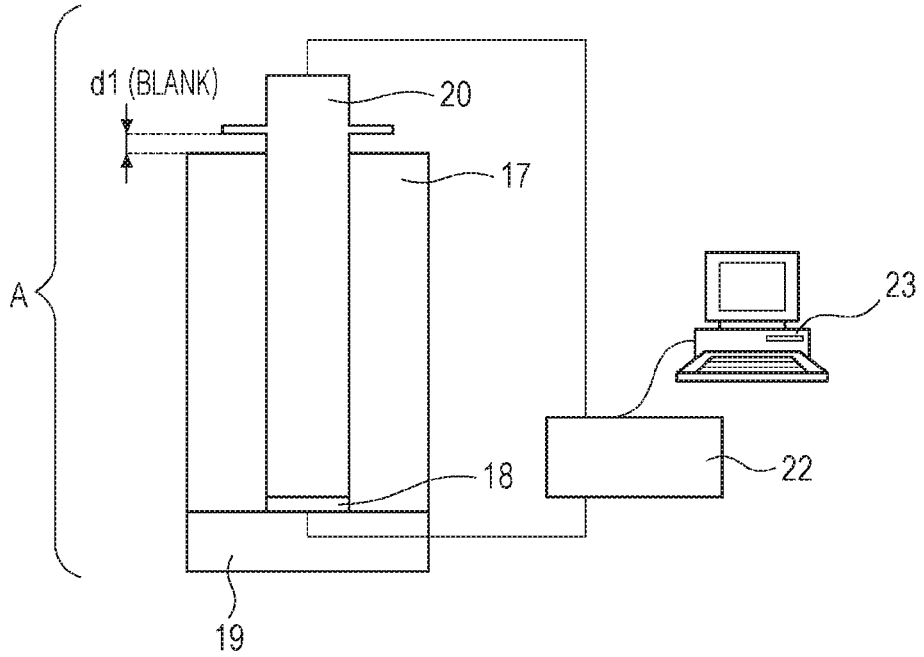
FIGS. 3A and 3B are schematic diagrams of an apparatus for measuring the specific resistance of a magnetic carrier.
Figure 3B:
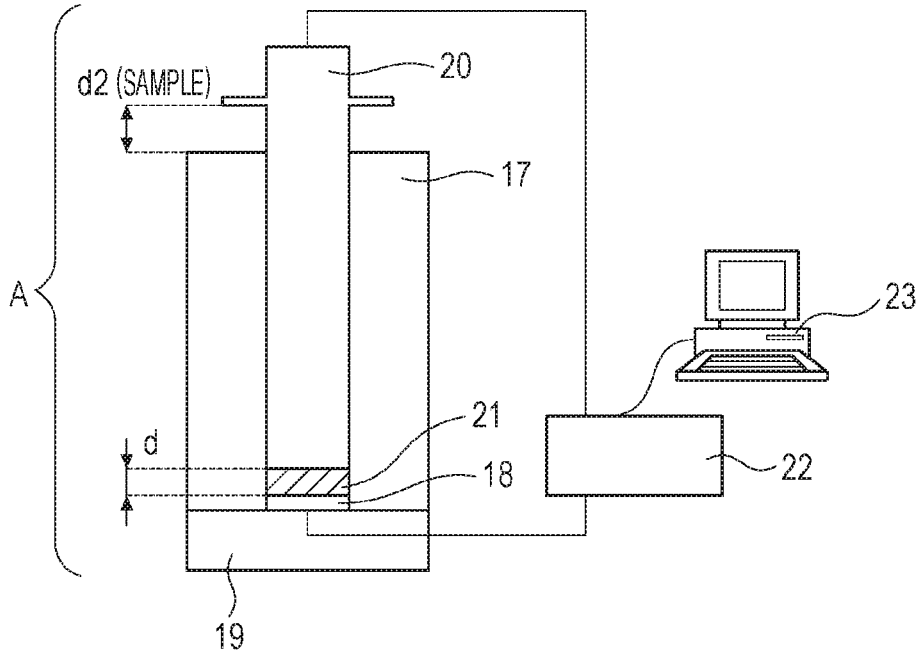

An electrical resistance measurement cell A includes a cylindrical container 17, composed of a polytetrafluoroethylene (PTFE) resin, having an opening with a cross-sectional area of 2.4 $cm^2$, a lower electrode 18 composed of stainless steel, a supporting base 19 composed of a PTFE resin, and an upper electrode 20 composed of stainless steel. The cylindrical container 17 is disposed on the supporting base 19. A sample 21 (the magnetic carrier or the magnetic carrier core particles) is placed into the cylindrical container 17 so as to have a thickness of about 1 mm. The upper electrode 20 is disposed on the sample 21. The thickness of the sample is measured. The thickness d of the sample is calculated from the following equation:

$$d = d2 - d1 \text{ (mm)}$$

where d1 represents a gap when no sample is placed as illustrated in FIG. 3A, and d2 represents a gap when the sample is placed so as to have a thickness of about 1 mm as illustrated in FIG. 3B.

The mass of the sample is appropriately adjusted in such a manner that the thickness d of the sample is 0.95 mm or more and 1.04 mm or less.

The specific resistance of the sample can be determined by applying a direct-current voltage between the electrodes and measuring the electric current flowing at this time. In this measurement, an electrometer 22 (Keithley 6517A, available from Keithley Instruments, Inc.) is used, and a processing computer 23 is used for control.

As the processing computer used for control, a control system, available from National Instruments Corp., and control software (LabVIEW, available from National Instruments Corp.) are used.

Measurement conditions are as follows: a sample-to-electrode contact area S of 2.4 $cm^2$, a measured thickness d of the sample in the range of 0.95 mm or more and 1.04 mm or less, an upper electrode load of 270 g, and a maximum applied voltage of 1,000 V.

Specific resistance (Ω·cm)=(applied voltage (V)/measured current (A))×$S$ ($cm^2$)/$d$(cm)

Electric field strength (V/cm)=applied voltage (V)/$d$ (cm)

The specific resistance of the magnetic carrier or the magnetic carrier core particles at the electric field strength is read from a graph.

(ii) Method for Measuring Volume-Average Particle Diameter (D50) of Magnetic Carrier Particle and Magnetic Carrier Core Particle The particle size distribution is measured with a laser diffraction/scattering particle size distribution analyzer "Microtrac MT3300EX" (available from Nikkiso Co., Ltd).

The volume average particle diameter (D50) is measured with the analyzer equipped with a sample feeder for dry measurement "One-shot dry sample conditioner Turbotrac" (available from Nikkiso Co., Ltd). The feed conditions for Turbotrac are as follows: a dust collector serving as a vacuum source is used at an airflow rate of about 33 L/s and a pressure of about 17 kPa. The analysis is automatically controlled by software. A 50% particle diameter (D50), which is a volume-average accumulated value, is determined as a particle diameter. Control and analysis are performed with associated software (version 10.3.3-202D). The measurement conditions are described below.

SetZero time: 10 s
Measurement time: 10 s
Number of measurements: 1
Refractive index of particle: 1.81%
Particle shape: Non-spherical
Upper limit of measurement: 1,408 μm
Lower limit of measurement: 0.243 μm
Measurement environment: 23° C., 50% RH (iii) Measurement of Pore Diameter and Pore Volume of Porous Magnetic Core Particle The pore size distribution of the porous magnetic core particles is measured by a mercury intrusion method.

The measurement principle is described below.

In this measurement, the pressure applied to mercury is changed, and the amount of mercury intruded into the pores is measured. The conditions in which mercury can intrude into a pore can be represented by $PD=-4\sigma \cos\theta$ based on the equilibrium of forces, where P denotes the pressure, D denotes the pore diameter, θ denotes the contact angle of mercury, and σ denotes the surface tension of mercury. Assuming that each of the contact angle and the surface tension is a constant, the pressure P is inversely proportional to the pore diameter D into which mercury can intrude at the pressure. In a P-V curve obtained by measuring the volumes V of mercury intruded into the pore at different pressures P, the horizontal axis P is simply converted into the pore diameter using the equation to determine the pore distribution.

As a measurement apparatus, for example, a PoreMaster series or PoreMaster-GT series fully-automatic multifunctional mercury porosimeter available from Yuasa Ionics Co., Ltd. or an AutoPore IV 9500 series automated porosimeter available from Shimadzu Corp. may be used.

Specifically, measurement is performed with AutoPore IV 9520 available from Shimadzu Corp. using the following procedure under the following conditions.

Measurement Conditions

| | | |
|---|---|---|
| Measurement environment | 20° C. | |
| Measurement cell | Sample volume | 5 $cm^3$ |
| | Intrusion volume used for powder | 1.1 $cm^3$ |
| Measurement range | 2.0 psia (13.8 kPa) or more and 59989.6 psia (413.7 kPa) or less | |
| Measurement step | 80 steps (at evenly spaced intervals on the logarithmic pore diameter) | |
| Intrusion parameter | | |
| Vacuum pressure | 50 μmHg | |
| Evacuation time | 5.0 minutes | |
| Mercury intrusion pressure | 2.0 psia (13.8 kPa) | |
| Equilibration time | 5 seconds | |
| High pressure parameter | Equilibration time | 5 seconds |
| Mercury parameter | Advancing contact angle | 130.0° |
| | Receding contact angle | 130.0° |
| | Surface tension | 485.0 mN/m (485.0 dyn/cm) |
| | Mercury density | 13.5335 g/mL |

Measurement Procedure (1) About 1.0 g of the porous magnetic core particles is weighed and placed into a sample cell. The weighted value is input.

(2) Measurement in the range of 2.0 psia (13.8 kPa) or more and 45.8 psia (315.6 kPa) or less in a low pressure portion is performed.

(3) Measurement in the range of 45.9 psia (316.3 kPa) or more and 59,989.6 psia (413.6 MPa) or less in a high pressure portion is performed.

(4) The pore size distribution is calculated from the mercury intrusion pressure and the volume of mercury intruded.

(2), (3), and (4) are automatically measured using associated software.

A pore diameter at the largest differential pore volume in the pore diameter range of 0.1 to 3.0 μm is read from the pore diameter distribution measured as described above and is defined as a pore diameter at the maximum differential pore volume.

A pore volume obtained by integrating the differential pore volume in the range of the pore diameter of 0.1 to 3.0 μm is calculated using the associated software, and defined as a pore volume.

(iv) Separation of Resin Covering Layer from Magnetic Carrier and Fractionation of Resin A and Resin B in Resin Covering Layer As a method for separating the resin covering layer from the magnetic carrier, a method is employed in which the magnetic carrier is placed in a cup and the cover resin is eluted with toluene.

After the eluted resin is evaporated to dryness, the dry resin is dissolved in tetrahydrofuran (THF) and fractionated with an apparatus described below.

Apparatus Configuration

LC-908, available from Japan Analytical Industry Co., Ltd.

JRS-86 repeat injector, available from Japan Analytical Industry Co., Ltd.

JAR-2 autosampler, available from Japan Analytical Industry Co., Ltd.

FC-201 fraction collector, available from Gilson, Inc.

Column Configuration

JAIGEL-1H to 5H, preparative columns, 20 mm in inside diameter×600 mm in length, available from Japan Analytical Industry Co., Ltd.

Measurement Conditions

Temperature: 40° C.

Solvent: THF

Flow rate: 5 mL/minute

Detector: RI

The elution times corresponding to the peak molecular weights (Mp) of the resin A and the resin B in the molecular weight distribution of the cover resin are measured in advance using a resin structure identified by a method described below. The resin components are fractionated before and after each of the elution times. After removal of the solvent, the resulting fractions are dried to give the resin A and the resin B.

Atomic groups can be identified from absorption wavenumbers measured with a Fourier-transform infrared spectrometer (Spectrum One, available from Perkin Elmer, Inc.) to determine the resin structures of the resin A and the resin B.

(v) Measurement of Weight-Average Molecular Weight (Mw) and Peak Molecular Weight (Mp) of Resin A, Resin B, and Resin Covering Layer and Measurement of Resin Content Ratio in Resin Covering Layer The weight-average molecular weights (Mw) and the peak molecular weights (Mp) of the resin A, the resin B, and all resins in the resin covering layer are measured by the following procedure using gel permeation chromatography (GPC).

Measurement samples are prepared as described below.

Samples (the cover resin separated from the magnetic carrier, and the resin A and the resin B fractionated with the preparative apparatus) are each mixed with tetrahydrofuran (THF) in a concentration of 5 mg/mL and allowed to stand at room temperature for 24 hours, thereby dissolving the samples in THF. Each of the resulting sample solutions is passed through a sample treatment filter (Maishori Disk H-25-2, available from Tosoh Corporation) to prepare a sample for GPC.

Measurement is performed with a GPC measuring instrument (HLC-8120 GPC, available from Tosoh Corporation) in accordance with the operation manual of the apparatus under measurement conditions described below.

Measurement Conditions

Instrument: high-speed GPC "HLC-8120 GPC" (available from Tosoh Corporation)

Column: A series of seven columns Shodex KF-801, 802, 803, 804, 805, 806, and 807 (available from Showa Denko K.K.)

Eluent: THF

Flow rate: 1.0 mL/minute

Oven temperature: 40.0° C.

Amount of sample injected: 0.10 mL

Upon calculation of the weight-average molecular weights (Mw) and the peak molecular weights (Mp) of the samples, a molecular weight calibration curve prepared with standard polystyrene resins (TSK Standard Polystyrene F-850, F-450, F-288, F-128, F-80, F-40, F-20, F-10, F-4, F-2, F-1, A-5000, A-2500, A-1000, and A-500, available from Tosoh Corporation) is used as a calibration curve.

Figure 5:
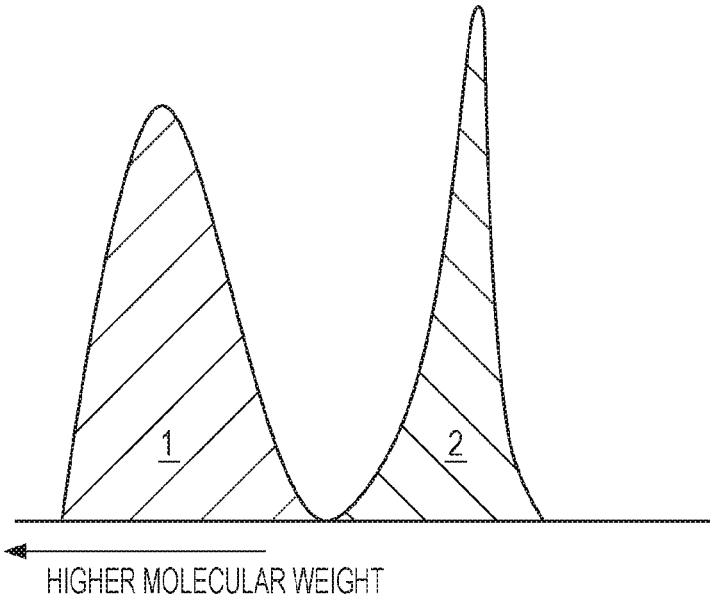
FIG. 5 illustrates a method for dividing resin components in a molecular weight distribution curve.
Figure 6:
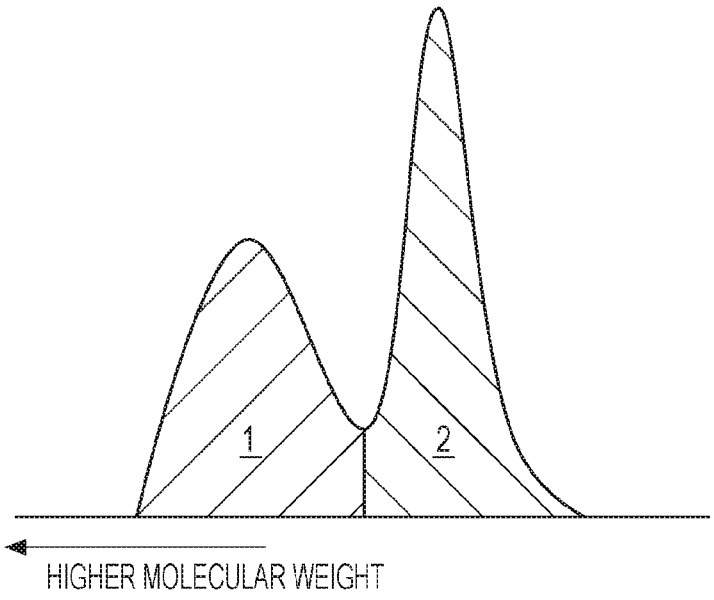
FIG. 6 illustrates a method for dividing resin components in a molecular weight distribution curve.

The resin content ratio is determined by a peak area ratio in the molecular weight distribution measurement. In the case where region 1 and region 2 are completely isolated as illustrated in FIG. 5, the resin content ratio is determined from the area ratio of the regions. In the case where the regions overlap with each other as illustrated in FIG. 6, the chromatogram pattern is divided by a line drawn perpendicularly to the horizontal axis from a point of inflection in the GPC molecular weight distribution curve, and the resin content ratio is determined from the area ratio of the region 1 to the region 2 illustrated in FIG. 6.

(vi) Method for Measuring N Element Content by XPS

The magnetic carrier particles from which the resin covering layer has been removed by the foregoing procedure are stuck on indium foil. At this time, the particles are uniformly stuck so as not to expose a portion of the indium foil. The measurement conditions of XPS analysis are listed below.

Instrument: PHI 5000 VERSAPROBE II (available from ULVAC-PHI, Inc.)

Irradiated radiation: Al Kd radiation

Output: 25 W, 15 Kv

Pass energy: 29.35 eV

Step size: 0.125 eV

XPS peak: $C_{2P}$, $N_{2P}$, $O_{2P}$, $Fe_{2P}$, and $Si_{2D}$; the N element content is determined by converting the elemental percentage of N element calculated from each peak into percentage by mass.

(vii) Measurement of Current Value

Figure 4:
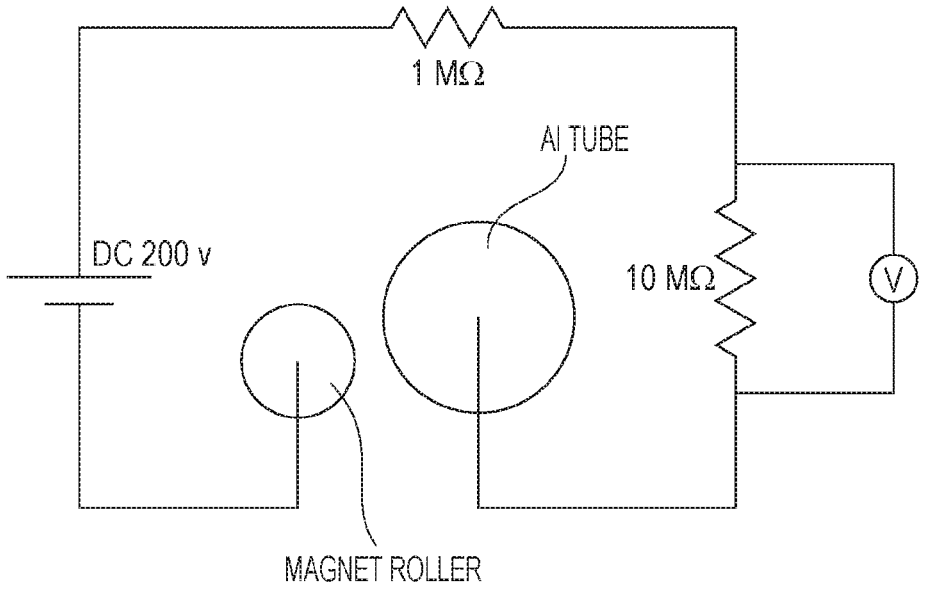
FIG. 4 is a schematic diagram of an apparatus for measuring a current value.

First, 800 g of the magnetic carrier is weighed and exposed to an environment with a temperature of 20° C. to 26° C. and a humidity of 50% to 60% RH for 15 minutes or more. A current value is measured with a current value measuring apparatus illustrated in FIG. 4 at an applied voltage of 500 V, the apparatus including electrodes formed of a magnet roller and an Al tube, the electrodes being spaced 4.5 mm apart.

(viii) Method for Measuring Weight-Average Particle Diameter (D4) and Number-Average Particle Diameter (D1)

The weight-average particle diameter (D4) and the number-average particle diameter (D1) are calculated as described below. A precision grain size distribution measuring apparatus provided with a 100-μm aperture tube based on an aperture impedance method, "Coulter Counter Multisizer 3" (registered trademark, available from Beckman Coulter, Inc.), is used. Dedicated software included with the apparatus "Beckman Coulter Multisizer 3 Version 3.51" (available from Beckman Coulter, Inc.) is used for setting measurement conditions and analyzing measurement data.

The measurement is performed while the number of effective measuring channels is set to 25,000. The measurement data is then analyzed.

An aqueous electrolyte solution prepared by dissolving reagent grade sodium chloride in deionized water in a concentration of about 1% by mass, for example, an "ISOTON II" (available from Beckman Coulter, Inc.), can be used as an aqueous electrolyte solution to be used in the measurement.

The dedicated software is set as described below prior to the measurement and the analysis.

In the "change standard measurement method (SOM)" screen of the dedicated software, the total count number of a control mode is set to 50,000 particles, the number of measurements is set to 1, and a value obtained by using "standard particles each having a particle size of 10.0 μm" (available from Beckman Coulter, Inc.) is set as a Kd value. A threshold and a noise level are automatically set by pressing a "threshold/noise level measurement" button. In addition, a current is set to 1,600 μA, a gain is set to 2, and an aqueous electrolyte solution is set to an ISOTON II, and a check mark is placed in a check box as to whether the aperture tube is flushed after the measurement.

In the "setting for conversion from pulse to particle size" screen of the dedicated software, a bin interval is set to a logarithmic particle size, the number of particle size bins is set to 256, and a particle size range is set to the range of 2 μm to 60 μm.

A specific measurement method is described below.

(1) About 200 mL of the aqueous electrolyte solution is placed into a 250-mL round-bottom glass beaker dedicated for the Multisizer 3. The beaker is set in a sample stand. The aqueous electrolyte solution in the beaker is stirred with a stirrer rod at 24 rotations/s in a counterclockwise direction. Then, dirt and bubbles in the aperture tube are removed by the "aperture flush" function of the analysis software.

(2) About 30 mL of the aqueous electrolyte solution is placed into a 100-mL flat-bottom glass beaker. About 0.3 mL of a diluted solution prepared by diluting a "Contaminon N" (a 10% by mass aqueous solution of a neutral detergent for washing a precision measuring device, the detergent containing a nonionic surfactant, an anionic surfactant, and an organic builder and having a pH of 7, available from Wako Pure Chemical Industries, Ltd.) with deionized water by 3-fold by mass is added as a dispersant to the aqueous electrolyte solution.

(3) An ultrasonic dispersing unit "Ultrasonic Dispersion System Tetra 150" (available from Nikkaki Bios Co., Ltd.) is used in which two oscillators each having an oscillatory frequency of 50 kHz are built so as to be out of phase by 180°, the ultrasonic dispersing unit having an electrical output of 120 W. A predetermined amount of deionized water is placed into the water tank of the ultrasonic dispersing unit. About 2 mL of the Contaminon N is placed into the water tank.

(4) The beaker described in (2) is set in the beaker fixing hole of the ultrasonic dispersing unit. The ultrasonic dispersing unit is operated. Then, the height position of the beaker is adjusted in such a manner that the liquid level of the aqueous electrolyte solution in the beaker resonates with an ultrasonic wave to the maximum extent possible.

(5) About 10 mg of toner is gradually added to and dispersed in the aqueous electrolyte solution in the beaker described in (4) while the aqueous electrolyte solution is irradiated with the ultrasonic wave. Then, the ultrasonic dispersion treatment is continued for additional 60 seconds. Note that the temperature of water in the water tank during the ultrasonic dispersion is appropriately adjusted so as to be 10° C. to 40° C.

(6) The aqueous electrolyte solution containing the toner dispersed therein in (5) is dropped with a pipette to the round-bottom beaker in section (1) placed in the sample stand, and the concentration of the toner to be measured is adjusted to about 5%. Then, measurement is performed until 50,000 particles are measured.

(7) The measurement data is analyzed with the dedicated software included with the apparatus, and the weight-average particle diameter (D4) and the number-average particle diameter (D1) are calculated. An "average diameter" on the "analysis/volume statistics (arithmetic average)" screen of the dedicated software when the dedicated software is set to show a graph in a vol % unit is the weight-average particle diameter (D4). An "average diameter" on the "analysis/number statistics (arithmetic average)" screen of the dedicated software when the dedicated software is set to show a graph in a number % unit is the number-average particle diameter (D1).

(ix) Method for Calculating Percentage of Presence of Particle Having Particle Diameter of 4.0 μm or Less The percentage (number %) of the presence of particles having a particle diameter of 4.0 μm or less in the toner is calculated by the following procedure. After the measurement with Multisizer 3, (1) the chart of the measurement results is displayed in terms of number % by setting the dedicated software to "graph/number %". (2) A check mark is placed in "<" of the particle diameter-setting portion in the "format/particle diameter/particle diameter statistics" screen, and "4" is input in the particle diameter-inputting portion below the particle diameter-setting portion. (3) The numerical value in the "<4 μm" display portion when the "analysis/number statistic (arithmetic average)" screen is displayed is the percentage by number of the presence of the particles having a particle diameter of 4.0 μm or less in the toner.

(x) Method for Calculating Percentage of Presence of Particle Having Particle Diameter of 10.0 μm or More The percentage (volume %) of the presence of particles having a particle diameter of 10.0 μm or more in the toner is calculated by the following procedure. After the measurement with Multisizer 3, (1) the chart of the measurement results is displayed in terms of volume % by setting the dedicated software to "graph/volume %". (2) A check mark is placed in ">" of the particle diameter-setting portion in the "format/particle diameter/particle diameter statistics" screen, and "10" is input in the particle diameter-inputting portion below the particle diameter-setting portion. (3) The numerical value in the ">10 μm" display portion when the "analysis/volume statistic (arithmetic average)" screen is displayed is the percentage by volume of the presence of the particles having a particle diameter of 10.0 μm or more in the toner.

EXAMPLES

While embodiments of the present disclosure will be more specifically described below with reference to examples, the present invention is not limited to these examples.

Production of Filler Resin 1 and 2

A methylsilicone oligomer (KR-400, available from Shin-Etsu Chemical Co., Ltd.) serving as a resin component and γ-aminopropyltriethoxysilane (KBM-903, available from Shin-Etsu Chemical Co., Ltd.) serving as an additive were mixed in proportions described in Table 1 to provide filler resins 1 and 2.

TABLE 1

| | Resin component | | Additive | |
|---|---|---|---|---|
| | Resin varnish | % by mass | Type of additive | % by mass |
| Filler resin 1 | methylsilicone oligomer | 100.0 | — | — |
| Filler resin 2 | methylsilicone oligomer | 95.0 | γ-aminopropyl-triethoxysilane | 5.0 |

Production Example of Resin A-1

Raw materials described in Table 2 (100.0 parts in total) were placed into a four-necked flask equipped with a reflux condenser, a thermometer, a nitrogen inlet, and a sealed stirrer. Furthermore, 100.0 parts of toluene, 100.0 parts of methyl ethyl ketone, and 2.4 parts of azobisisobutyronitrile were added thereto. The mixture was maintained at 80° C. for 10 hours under a stream of nitrogen to complete polymerization. Removal of the solvent gave resin A-1.

TABLE 2

| | Main chain monomer | | Macromonomer | | | |
|---|---|---|---|---|---|---|
| | Constituting monomer | Amount added (% by mass) | Constituting monomer | Weight-average molecular weight Mw | Amount added (% by mass) | Weight-average molecular weight Mw |
| Resin A-1 | cyclohexyl methacrylate | 69.5 | methyl methacrylate | 5000 | 30.0 | 40,000 |
| | methyl methacrylate | 0.5 | | | | |

Production Example of Resin B-1

Into an autoclave, 500 parts by mass of xylene was placed. After nitrogen purging, the temperature was raised to 185° C. under stirring in a sealed state. A mixed solution of raw materials described in Table 3, 50 parts by mass of di-tert-butyl peroxide, and 200 parts by mass of xylene was continuously added dropwise thereto over a period of 3 hours to perform polymerization while the temperature in the autoclave was controlled to 185° C. The mixture was maintained at the same temperature for 1 hour to complete the polymerization. Removal of the solvent gave resin B-1.

TABLE 3

| | Monomer | | Weight-average |
|---|---|---|---|
| | Constituting monomer | Amount added (% by mass) | molecular weight (Mw) |
| Resin B-1 | styrene | 99.99 | 3,000 |
| | butyl acrylate | 0.01 | |

Production Example of Magnetic Carrier Core Particle 1

Step 1 (Weighing and Mixing Step)

| | |
|---|---|
| $Fe_2O_3$ | 68.3% by mass |
| $MnCO_3$ | 28.5% by mass |
| $Mg(OH)_2$ | 2.0% by mass |
| $SrCO_3$ | 1.2% by mass |

The foregoing raw materials for ferrite were weighed. Then 20 parts by mass of water was added to 80 parts by mass of the mixture of the raw materials for ferrite. The mixture was wet-mixed for 3 hours with a ball mill using zirconia balls having a diameter of 10 mm to prepare a slurry. The slurry had a solid content concentration of 80% by mass.

Step 2 (Calcination Step)

The resulting slurry was dried with a spray dryer (available from Ohkawara Kakohki Co., Ltd.) and then fired in a batch type electric furnace in a nitrogen atmosphere (oxygen concentration: 1.0% by volume) at 1,050° C. for 3.0 hours to produce calcined ferrite.

Step 3 (Pulverization Step)

The calcined ferrite was crushed with a crusher so as to have a size of about 0.5 mm. Water was added thereto to prepare a slurry. The slurry had a solid content concentration of 70% by mass. The slurry was wet-ground in a ball mill using ⅛-inch stainless beads for 3 hours to prepare a slurry. The resulting slurry was wet-pulverized in a bead mill using zirconia beads having a diameter of 1 mm for 4 hours to prepare a calcined ferrite slurry having a 50% particle diameter (D50) of 1.3 μm on a volume basis.

Step 4 (Granulation Step)

To 100 parts by mass of the calcined ferrite slurry, 1.0 parts by mass of an ammonium polycarboxylate serving as a dispersant and 1.5 parts by mass of poly(vinyl alcohol) serving as a binder were added. The mixture was granulated to spherical particles with a spray dryer (available from Ohkawara Kakohki Co., Ltd.) and dried. The resulting granulated material was subjected to particle size adjustment and heated at 700° C. for 2 hours with a rotary electric furnace to remove organic substances such as the dispersant and the binder.

Step 5 (Firing Step)

The resulting particles were heated from room temperature to a firing temperature (1,100° C.) over a period of 2 hours in a nitrogen atmosphere (oxygen concentration: 1.0% by volume) and held at 1,100° C. for 4 hours for firing. The temperature was lowered to 60° C. over a period of 8 hours. The atmosphere was changed from the nitrogen atmosphere to air. The fired particles were taken out at 40° C. or lower.

Step 6 (Screening Step)

The aggregated particles were disaggregated and then sifted through a sieve with 150-μm openings to remove coarse particles. Fine particles were removed by wind classification. Furthermore, particles having a low magnetic force were removed by magnetic separation to provide porous magnetic core particles. The resulting porous magnetic core particles were porous particles and had a pore diameter of 0.60 μm and a pore volume of 75 $mm^3/g$.

Step 7 (Filling Step)

Into the stirring container of a mixing stirrer (NDMV universal stirrer, available from Dalton Co., Ltd.), 100 parts by mass of the porous magnetic core particles. The temperature was maintained at 60° C., and 5 parts by mass of the filler resin 1 was added dropwise thereto at atmospheric pressure.

After the completion of the dropwise addition, stirring was continued while adjusting the time. The temperature was raised to 70° C. to fill the resin composition into the porous magnetic core particles.

After cooling, the resulting resin-filled magnetic core particles were transferred into a mixer including a rotatable mixing container having spiral blades therein (UD-AT drum mixer, available from Sugiyama Heavy Industrial Co., Ltd.) and heated to 140° C. at a rate of temperature increase of 2° C./minute in a nitrogen atmosphere under stirring. Then heating and stirring were continued at 140° C. for 50 minutes.

Then cooling to room temperature was performed. The ferrite particles filled with the cured resin were taken out. A non-magnetic material was removed with a magnetic separator. Furthermore, coarse particles were removed with a vibrating sieve. The ferrite particles were placed into a planetary-screw mixer (Nauta Mixer, type VN, available from Hosokawa Micron Corporation) and stirred in a reduced pressure state (75 mmHg) under a stream of nitrogen at a flow rate of 0.1 $m^3$/minute while a screw-type stirring blade revolved at 3.5 revolutions per minute and rotated at 100 rotations per minute. After the temperature was raised to 70° C., 0.50 parts by mass of γ-aminopropyltriethoxysilane diluted to 10 times with toluene was added thereto with respect to 100 parts by mass of the resin-filled carrier particles in the mixer. After an application operation was performed for 20 minutes, the mixture was transferred into a mixer including a rotatable mixing container having spiral blades therein (UD-AT drum mixer, available from Sugiyama Heavy Industrial Co., Ltd). The mixture was subjected to heat treatment at 150° C. for 2 hours in a nitrogen atmosphere while the mixture was stirred by rotating the mixing container at 10 rotations per minute, thereby providing resin-filled magnetic carrier core particles 1 having amino groups on surfaces thereof. The resulting magnetic carrier core particles 1 had a N element content of 3.0%. Details are presented in Table 4.

Magnetic Carrier Core Particle 2 to 12

Magnetic carrier core particles 2 to 12 were produced as in the production example of the magnetic carrier core particles 1, except that different types of materials and different amounts added were used as presented in Table 4.

TABLE 4

| | Core material | Filler resin | Amount of filler resin (part by mass) | Amino group-containing compound | Amount of Amino group-containing compound added (part by mass) | N element content (% by mass) |
|---|---|---|---|---|---|---|
| Magnetic carrier core particle 1 | porous magnetic core particle | filler resin 1 | 5.00 | γ-aminopropyltriethoxysilane | 0.50 | 3.0 |
| Magnetic carrier core particle 2 | porous magnetic core particle | filler resin 1 | 5.00 | γ-aminopropyltriethoxysilane | 0.10 | 1.0 |
| Magnetic carrier core particle 3 | porous magnetic core particle | filler resin 1 | 5.00 | γ-aminopropyltriethoxysilane | 0.85 | 5.0 |
| Magnetic carrier core particle 4 | porous magnetic core particle | filler resin 1 | 5.00 | γ-aminopropyltriethoxysilane | 0.09 | 0.9 |
| Magnetic carrier core particle 5 | porous magnetic core particle | filler resin 2 | 5.00 | — | — | — |
| Magnetic carrier core particle 6 | porous magnetic core particle | filler resin 1 | 5.00 | γ-aminopropyltriethoxysilane | 0.90 | 5.1 |
| Magnetic carrier core particle 7 | porous magnetic core particle | filler resin 1 | 5.00 | γ-aminopropyltriethoxysilane | 0.05 | 0.5 |
| Magnetic carrier core particle 8 | porous magnetic core particle | filler resin 1 | 5.00 | γ-aminopropyltriethoxysilane | 1.50 | 7.0 |
| Magnetic carrier core particle 9 | porous magnetic core particle | filler resin 1 | 5.00 | γ-aminopropyltriethoxysilane | 0.03 | 0.4 |
| Magnetic carrier core particle 10 | porous magnetic core particle | filler resin 1 | 5.00 | γ-aminopropyltriethoxysilane | 1.60 | 7.2 |
| Magnetic carrier core particle 11 | porous magnetic core particle | filler resin 1 | 5.00 | — | — | — |
| Magnetic carrier core particle 12 | porous magnetic core particle | filler resin 1 | 5.00 | γ-aminopropyltrimethoxysilane | 0.03 | 0.4 |

Production Example of Magnetic Carrier 1

| | |
|---|---|
| Magnetic carrier core particles 1 | 100 parts by mass |
| Resin A-1 | 1.40 parts by mass |
| Resin B-1 | 0.60 parts by mass |
| n-Octyltriethoxysilane | 0.20 parts by mass |

The resin components (the total of the resin A-1 and the resin B-1) were diluted with toluene so as to have a concentration of 5% by mass. Then n-octyltriethoxysilane was added thereto. The mixture was sufficiently stirred to prepare a resin solution. Next, 100 parts of the magnetic carrier core particles 1 were placed into a planetary-screw mixer (Nauta Mixer, type VN, available from Hosokawa Micron Corporation) maintained at a temperature of 60° C. Half the volume of the resin solution was added thereto. After solvent removal and application operations were performed for 30 minutes, the rest of the resin solution was added thereto. Solvent removal and application operations were performed for 40 minutes.

The particles covered with the resin covering layers were transferred into a mixer including a rotatable mixing container having spiral blades therein (UD-AT drum mixer, available from Sugiyama Heavy Industrial Co., Ltd). The mixture was subjected to heat treatment at 120° C. for 2 hours in a nitrogen atmosphere while the mixture was stirred by rotating the mixing container at 10 rotations per minute. The resulting particles were subjected to magnetic separation to remove particles having a low magnetic force. The particles was passed through a sieve having 150-μm openings and then classified with a wind classifier to provide magnetic carrier 1.

Production Example of Magnetic Carrier 2 to 26

Magnetic carriers 2 to 26 were produced as in the production example of the magnetic carrier 1, except that different types of materials and different amounts added were used as presented in Table 5.

TABLE 5

| | | Cover resin | | | | |
|---|---|---|---|---|---|---|
| | | | | Total amount | Compound represented by formula (1) | |
| | Magnetic core | Resin A-1 Amount used (part by mass) | Resin B-1 Amount used (part by mass) | of cover resin (part by mass) | Type | Amount added (part by mass) |
| Magnetic carrier 1 | magnetic carrier core particle 1 | 1.40 | 0.60 | 2.00 | n-octyltriethoxysilane | 0.2 |
| Magnetic carrier 2 | magnetic carrier core particle 2 | 1.40 | 0.60 | 2.00 | n-octyltriethoxysilane | 0.2 |
| Magnetic carrier 3 | magnetic carrier core particle 3 | 1.40 | 0.60 | 2.00 | n-octyltriethoxysilane | 0.2 |
| Magnetic carrier 4 | magnetic carrier core particle 4 | 1.40 | 0.60 | 2.00 | n-octyltriethoxysilane | 0.2 |
| Magnetic carrier 5 | magnetic carrier core particle 5 | 1.40 | 0.60 | 2.00 | n-octyltriethoxysilane | 0.2 |
| Magnetic carrier 6 | magnetic carrier core particle 6 | 1.40 | 0.60 | 2.00 | n-octyltriethoxysilane | 0.2 |
| Magnetic carrier 7 | magnetic carrier core particle 7 | 1.40 | 0.60 | 2.00 | n-octyltriethoxysilane | 0.2 |
| Magnetic carrier 8 | magnetic carrier core particle 8 | 1.40 | 0.60 | 2.00 | n-octyltriethoxysilane | 0.2 |
| Magnetic carrier 9 | magnetic carrier core particle 9 | 1.40 | 0.60 | 2.00 | n-octyltriethoxysilane | 0.2 |
| Magnetic carrier 10 | magnetic carrier core particle 10 | 1.40 | 0.60 | 2.00 | n-octyltriethoxysilane | 0.2 |
| Magnetic carrier 11 | magnetic carrier core particle 9 | 1.40 | 0.60 | 2.00 | n-octyltriethoxysilane | 0.1 |
| Magnetic carrier 12 | magnetic carrier core particle 9 | 2.00 | — | 2.00 | n-octyltriethoxysilane | 0.1 |
| Magnetic carrier 13 | magnetic carrier core particle 9 | 2.00 | — | 2.00 | n-octyltriethoxysilane | 0.6 |
| Magnetic carrier 14 | magnetic carrier core particle 9 | 2.00 | — | 2.00 | n-octyltriethoxysilane | 0.09 |
| Magnetic carrier 15 | magnetic carrier core particle 9 | 2.00 | — | 2.00 | n-octyltriethoxysilane | 0.7 |
| Magnetic carrier 16 | magnetic carrier core particle 9 | 2.00 | — | 2.00 | n-hexyltriethoxysilane | 0.09 |
| Magnetic carrier 17 | magnetic carrier core particle 9 | 2.00 | — | 2.00 | n-decyltrimethoxysilane | 0.09 |
| Magnetic carrier 18 | magnetic carrier core particle 9 | 2.00 | — | 2.00 | n-dodecyltrimethoxysilane | 0.09 |
| Magnetic carrier 19 | magnetic carrier core particle 9 | 2.00 | — | 2.00 | isooctyltrimethoxysilane | 0.09 |
| Magnetic carrier 20 | magnetic carrier core particle 12 | 2.00 | — | 2.00 | isooctyltrimethoxysilane | 0.09 |
| Magnetic carrier 21 | magnetic carrier core particle 9 | 2.00 | — | 2.00 | — | — |
| Magnetic carrier 22 | magnetic carrier core particle 11 | 2.00 | — | 2.00 | n-dodecyltrimethoxysilane | 0.09 |
| Magnetic carrier 23 | magnetic carrier core particle 11 | 2.00 | — | 2.00 | — | — |
| Magnetic carrier 24 | magnetic carrier core particle 9 | 2.00 | — | 2.00 | n-butyltrimethoxysilane | 0.09 |
| Magnetic carrier 25 | magnetic carrier core particle 9 | 2.00 | — | 2.00 | n-hexadecyltrimethoxysilane | 0.09 |
| Magnetic carrier 26 | magnetic carrier core particle 9 | 2.00 | — | 2.00 | n-dodecyldimethylchlorosilane | 0.09 |

Production Example of Toner

Binder resin (polyester): 100 parts by mass
(Tg: 57° C., acid value: 12 mgKOH/g, hydroxyl value: 15 mgKOH/g)
C.I. Pigment Blue 15:3: 5.5 parts by mass
3,5-Di-tert-butylsalicylic acid aluminum compound: 0.2 parts by mass
n-Paraffin wax (melting point: 90° C.): 6.0 parts by mass The foregoing materials were thoroughly mixed in a Henschel mixer (Model: FM-75J, available from Nippon Coke & Engineering Co., Ltd.) and then kneaded (kneaded material temperature at ejection: 150° C.) at a feed rate of 10 kg/h using a twin-screw kneader (trade name: Model PCM-30, Ikegai Ironworks Corp.) set to a temperature of 130° C. The resulting kneaded material was cooled, coarsely crushed with a hammer mill, and finely pulverized at a feed rate of 15 kg/h with a mechanical pulverizer (trade name: T-250, Turbo Kogyo Co., Ltd), thereby providing particles having a weight-average particle diameter of 5.5 μm and containing 55.6% by number particles having a particle diameter of 4.0 μm or less and 0.8% by volume particles having a particle diameter of 10.0 μm or more.

The resulting particles were subjected to classification to remove fine particles and coarse particles with a rotary classifier (trade name: TTSP100, available from Hosokawa Micron Corporation). Thereby, cyan toner particles 1 having a weight-average particle diameter of 6.0 μm were produced, the percentage of the presence of particles with a particle diameter of 4.0 μm or less being 27.8% by number, the percentage of the presence of particles with a particle diameter of 10.0 μm or more being 2.2% by volume.

Materials listed below were placed into a Henschel mixer (Model: FM-75J, available from Nippon Coke & Engineering Co., Ltd.) and mixed for 3 minutes at a peripheral speed of a rotary blade of 35.0 (m/s), thereby providing cyan toner 1.

| | |
|---|---|
| Cyan toner particles 1 | 100 parts by mass |
| Silica particles (provided by subjecting silica particles having a primary particle number-average particle diameter of 10 nm to surface treatment with hexamethyldisilazane) | 0.5 parts by mass |
| Titanium oxide particles (provided by subjecting metatitanic acid having a primary particle number-average particle diameter of 30 nm to surface treatment with an octylsilane compound) | 0.5 parts by mass |

Preparation of Two-Component Developer

The toner 1 was mixed with each of the magnetic carriers 1 to 26 in a toner concentration of 8% by shaking on a shaker (Model: YS-8D, available from Yayoi Co., Ltd). Thereby, two-component developers 1 to 26 were prepared. The shaker was operated at 200 rpm for 2 minutes.

Meanwhile, 9 parts by mass of the toner 1 was added to 1 part by mass of each of the magnetic carriers 1 to 26. The mixture was mixed with a V-type mixer for 5 minutes. Thereby, developers 1 to 26 for replenishment were prepared.

Examples 1 to 20 and Comparative Examples 1 to 6

The following evaluation was performed on the resulting two-component developers and the developers for replenishment.

As an image forming apparatus, a modified imagePRESS C850 color copier available from CANON KABUSHIKI KAISHA was used.

Before the formation of images, a developer in a cyan developing unit was replaced with each of the two-component developers 1 to 26, and a developer for replenishment in a cyan developing unit for a developer for replenishment was replaced with the developers 1 to 26 for replenishment. Modification points are described below.

(1) The modifications were made such that development contrast could be adjusted to a freely-selected value and such that automatic correction by the main body did not work.

(2) The modifications were made such that the alternating-current component of a developing bias had a frequency of 2.0 kHz and such that a peak-to-peak voltage (Vpp) could be changed from 0.7 kV to 1.8 kV in increments of 0.1 kV.

(3) The modification was made such that an image could be formed in a single color.

Image formation was performed on laser beam printer sheets (CS-814, basis weight: 81.4 g/m$^2$, available from Canon Marketing Japan Inc.) as recording paper in a single cyan color with the modified machine. An evaluation test was performed as described below.

An FFH output chart having an image percentage of 1% was used for image formation. FFH is a value obtained by representing 256 gray levels in hexadecimal notation. 00h refers to the first gray level (white background portion) of the 256 gray levels. FFH refers to the 256th gray level (solid portion) of the 256 gray levels.

FFH images each having a size of 15 mm×15 mm (toner laid-on level on paper: 0.35 mg/cm$^2$) were output on a total of nine places, i.e., central and end portions, of recording paper (CS-814) in an N/L environment (temperature: 23° C., humidity: 5 RH %) or H/H environment (temperature: 30° C., humidity 80 RH %). The density of the central portion of each of the images was measured with an X-Rite 404A color reflection densitometer. The average value of the measured image densities was determined. After the FFH output chart having an image percentage of 1% was output on 10,000 sheets in the same environments, the evaluation image was output in the same manner before the output, and the average value of the measured image densities was determined. Similarly, the average value of the image densities was determined every 10,000 sheets until the total number of output sheets reached 50,000. The difference between the maximum value and the minimum value among the obtained six average values was calculated and evaluated according to the following criteria. Table 6 presents the evaluation results.

Evaluation Criteria

A: The difference is 0.02 or less.
B: The difference is more than 0.02 and 0.05 or less.
C: The difference is more than 0.05 and 0.08 or less.
D: The difference is more than 0.08 and 0.10 or less.
E: The difference is more than 0.10 and 0.13 or less.
F: The difference is more than 0.13 and 0.15 or less.
G: The difference is more than 0.15 and 0.20 or less.
H: The difference is more than 0.20.

TABLE 6

| | | | Change in image density | | | |
|---|---|---|---|---|---|---|
| | | | 23° C./5% | | 30° C./80% | |
| | Two-component developer | Developer for replenishment | Difference in density | Evaluation | Difference in density | Evaluation |
| Example 1 | 1 | 1 | 0.00 | A | 0.00 | A |
| Example 2 | 2 | 2 | 0.01 | A | 0.03 | B |
| Example 3 | 3 | 3 | 0.04 | B | 0.01 | A |
| Example 4 | 4 | 4 | 0.02 | A | 0.06 | C |
| Example 5 | 5 | 5 | 0.02 | A | 0.07 | C |
| Example 6 | 6 | 6 | 0.06 | C | 0.02 | A |
| Example 7 | 7 | 7 | 0.02 | A | 0.09 | D |
| Example 8 | 8 | 8 | 0.09 | D | 0.02 | A |
| Example 9 | 9 | 9 | 0.02 | A | 0.12 | E |
| Example 10 | 10 | 10 | 0.11 | E | 0.02 | A |
| Example 11 | 11 | 11 | 0.05 | B | 0.06 | C |
| Example 12 | 12 | 12 | 0.07 | C | 0.09 | D |
| Example 13 | 13 | 13 | 0.08 | C | 0.11 | E |
| Example 14 | 14 | 14 | 0.09 | D | 0.10 | D |
| Example 15 | 15 | 15 | 0.08 | C | 0.14 | F |
| Example 16 | 16 | 16 | 0.09 | D | 0.12 | E |
| Example 17 | 17 | 17 | 0.12 | E | 0.08 | C |
| Example 18 | 18 | 18 | 0.14 | F | 0.08 | C |
| Example 19 | 19 | 19 | 0.12 | E | 0.15 | F |
| Example 20 | 20 | 20 | 0.13 | E | 0.15 | F |
| Comparative example 1 | 21 | 21 | 0.16 | G | 0.21 | H |
| Comparative example 2 | 22 | 22 | 0.15 | F | 0.17 | G |
| Comparative example 3 | 23 | 23 | 0.21 | H | 0.22 | H |

TABLE 6-continued

| | | | Change in image density | | | |
|---|---|---|---|---|---|---|
| | | | 23° C./5% | | 30° C./80% | |
| | Two-component developer | Developer for replenishment | Difference in density | Evaluation | Difference in density | Evaluation |
| Comparative example 4 | 24 | 24 | 0.13 | E | 0.19 | G |
| Comparative example 5 | 25 | 25 | 0.18 | G | 0.15 | F |
| Comparative example 6 | 26 | 26 | 0.20 | G | 0.19 | G |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-163656 filed Aug. 31, 2018, which is hereby incorporated by reference herein in its entirety.

What is claimed is:

1. A magnetic carrier, comprising:

a magnetic carrier particle including:

a magnetic carrier core particle having an amino group on a surface thereof, and a resin covering layer disposed on the surface of the magnetic carrier core particle, wherein the resin covering layer contains:

a vinyl-based copolymer, and a compound represented by Formula (1):

(1)

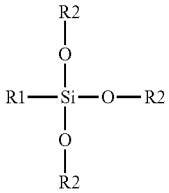

where R1 is a chain alkyl group having 6 to 12 carbon atoms, and each R2 is independently a methyl group or an ethyl group.

2. The magnetic carrier according to claim 1, wherein R1 in Formula (1) is a chain alkyl group having 6 to 10 carbon atoms.

3. The magnetic carrier according to claim 1, wherein R1 in Formula (1) is a linear alkyl group.

4. The magnetic carrier according to claim 1, wherein the compound represented by Formula (1) is contained in an amount of 5 parts or more by mass and 30 parts or less by mass per 100 parts by mass of a resin component in the resin covering layer.

5. The magnetic carrier according to claim 1, wherein the resin covering layer contains a resin A and a resin B, the resin A is a copolymer of:

(a) a (meth)acrylate monomer having an alicyclic hydrocarbon group represented by Formula (2):

(2)

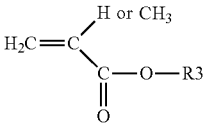

where R3 is an alicyclic hydrocarbon group, and (b) a vinyl-based macromonomer represented by Formula (3):

(3)

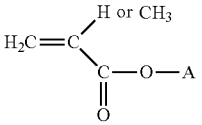

where A is a monovalent group obtained by removing one hydrogen atom from a polymer of at least one monomer selected from the group consisting of methyl acrylate, methyl methacrylate, butyl acrylate, butyl methacrylate, 2-ethylhexyl acrylate, and 2-ethylhexyl methacrylate, and the resin B is a copolymer of:

(c) a styrene-based monomer, and (d) a (meth)acrylate monomer represented by Formula (4):

(4)

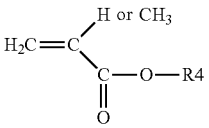

where R4 is a chain alkyl group having 2 to 8 carbon atoms.

6. The magnetic carrier according to claim 1, wherein the magnetic carrier core particle has an N element content of 0.50% or more by mass and 7.00% or less by mass, the N element content being measured by X-ray photoelectron spectroscopy.

7. The magnetic carrier according to claim 1, wherein the magnetic carrier core particle has an N element content of 1.00% or more by mass and 5.00% or less by mass, the N element content being measured by X-ray photoelectron spectroscopy.

8. A two-component developer, comprising:
a toner including:
a toner particle containing:
a binder resin,
a colorant, and
a release agent; and
a magnetic carrier,
wherein the magnetic carrier includes:
a magnetic carrier particle including:
a magnetic carrier core particle having an amino group on a surface thereof, and
a resin covering layer disposed on the surface of the magnetic carrier core particle, and
wherein the resin covering layer contains:
a vinyl-based copolymer, and
a compound represented by Formula (1):

(1)

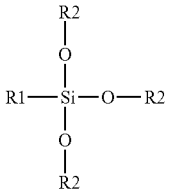

where R1 is a chain alkyl group having 6 to 12 carbon atoms, and each R2 is independently a methyl group or an ethyl group.

9. An image forming method, comprising:
charging an electrostatic latent image-bearing member;
forming an electrostatic latent image on a surface of the electrostatic latent image-bearing member;
developing the electrostatic latent image with a two-component developer to form a toner image;
transferring the toner image to a transfer material with or without an intermediate transfer member; and
fixing the transferred toner image on the transfer material,
wherein the two-component developer including:
a toner including:
a toner particle containing:
a binder resin,
a colorant, and
a release agent; and
a magnetic carrier,
wherein the magnetic carrier includes:
a magnetic carrier particle including:
a magnetic carrier core particle having an amino group on a surface thereof, and
a resin covering layer disposed on the surface of the magnetic carrier core particle, and
wherein the resin covering layer contains:
a vinyl-based copolymer, and
a compound represented by Formula (1):

(1)

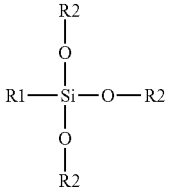

where R1 is a chain alkyl group having 6 to 12 carbon atoms, and each R2 is independently a methyl group or an ethyl group.

10. A developer for replenishment for use in an image forming method, the developer comprising:
a toner including:
a magnetic carrier for replenishment, and
a toner particle containing:
a binder resin,
a colorant, and
a release agent,
the method including:
charging an electrostatic latent image-bearing member,
forming an electrostatic latent image on a surface of the electrostatic latent image-bearing member,
the electrostatic latent image with a two-component developer in a developing unit to form a toner image,
transferring the toner image to a transfer material with or without an intermediate transfer member, and
fixing the transferred toner image on the transfer material,
wherein the developer for replenishment is supplied to the developing unit in response to a decrease in toner concentration of the two-component developer in the developing unit, and an excess of the magnetic carrier in the developing unit is discharged from the developing unit as needed,
wherein the developer for replenishment contains 2 parts or more by mass and 50 parts or less by mass of the toner per 1 part by mass of the magnetic carrier for replenishment,
the magnetic carrier for replenishment includes:
a magnetic carrier particle including:
a magnetic carrier core particle having an amino group on a surface thereof, and
a resin covering layer disposed on the surface of the magnetic carrier core particle, and
the resin covering layer contains:
a vinyl-based copolymer, and
a compound represented by Formula (1):

(1)

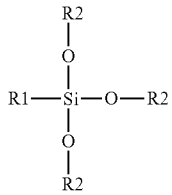

where R1 is a chain alkyl group having 6 to 12 carbon atoms, and each R2 is independently a methyl group or an ethyl group.

11. An image forming method, comprising:
charging an electrostatic latent image-bearing member;
forming an electrostatic latent image on a surface of the electrostatic latent image-bearing member;
developing the electrostatic latent image with a two-component developer in a developing unit to form a toner image;
transferring the toner image to a transfer material with or without an intermediate transfer member; and
fixing the transferred toner image on the transfer material,
a developer for replenishment being supplied to the developing unit in response to a decrease in toner concentration of the two-component developer in the developing unit, an excess of a magnetic carrier in the developing unit being discharged from the developing unit as needed, wherein the developer for replenishment includes:

a toner including:

the magnetic carrier for replenishment, and a toner particle containing:

a binder resin, a colorant, and a release agent, the developer for replenishment contains 2 parts or more by mass and 50 parts or less by mass of the toner per 1 part by mass of the magnetic carrier for replenishment, the magnetic carrier for replenishment includes:

a magnetic carrier particle including:

a magnetic carrier core particle having an amino group on a surface thereof, and a resin covering layer disposed on the surface of the magnetic carrier core particle, and the resin covering layer contains:

a vinyl-based copolymer, and a compound represented by Formula (1):

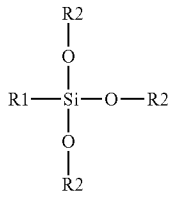

(1)

where R1 is a chain alkyl group having 6 to 12 carbon atoms, and each R2 is independently a methyl group or an ethyl group.

* * * * *